US005932390A

United States Patent [19]

Ishigaki et al.

[11] Patent Number: 5,932,390

[45] **Date of Patent: *Aug. 3, 1999**

[54] SILVER HALIDE PHOTOGRAPHIC MATERIAL

[75] Inventors: Kunio Ishigaki; Junichi Yamanouchi; Hidetoshi Watanabe, all of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/598,972

[22] Filed: Feb. 9, 1996

[30] Foreign Application Priority Data

Feb. 13, 1995 [JP] Japan ..... 7-46687

[51] Int. Cl.[6] ..... G03C 1/04; G03C 1/053

[52] U.S. Cl. ..... 430/264; 430/627; 430/536; 430/434; 430/950

[58] Field of Search ..... 430/264, 627, 430/536, 950, 434

[56] References Cited

U.S. PATENT DOCUMENTS

| | | | |
|---|---|---|---|
| H1016 | 1/1992 | Hatakeyama et al. | 430/535 |
| 2,763,625 | 9/1956 | Illingsworth et al. | 430/514 |
| 2,852,382 | 9/1958 | Illingsworth et al. | 430/545 |
| 4,269,929 | 5/1981 | Nothnagle | 430/264 |
| 4,308,335 | 12/1981 | Yamamoto et al. | 430/213 |
| 4,478,928 | 10/1984 | Hess et al. | 430/217 |
| 4,714,671 | 12/1987 | Helling et al. | 430/545 |
| 4,994,353 | 2/1991 | Hatakeyama et al. | 430/496 |
| 5,026,632 | 6/1991 | Bagchi et al. | 430/545 |
| 5,561,034 | 10/1996 | Desie et al. | 430/536 |
| 5,804,357 | 9/1998 | Yamanouchi et al. | 430/438 |

FOREIGN PATENT DOCUMENTS

| | | | |
|---|---|---|---|
| A20117511 | 9/1984 | European Pat. Off. | G03C 7/32 |
| A20343642 | 11/1989 | European Pat. Off. | G03C 1/04 |
| A10510961 | 10/1992 | European Pat. Off. | G03C 1/95 |
| A10514903 | 11/1992 | European Pat. Off. | G03C 1/76 |
| A30713131 | 5/1996 | European Pat. Off. | G03C 1/06 |
| A20716338 | 6/1996 | European Pat. Off. | G03C 1/053 |
| 45-5819 | 2/1970 | Japan . | |
| 46-22507 | 6/1971 | Japan . | |
| 50-73625 | 6/1975 | Japan | G03C 1/04 |
| 60-15935 | 4/1985 | Japan | G03C 1/04 |
| 62-115152 | 5/1987 | Japan | G03C 1/82 |
| 464058 | 10/1992 | Japan | G03C 1/04 |
| 566512 | 3/1993 | Japan | G03C 1/04 |
| 580449 | 4/1993 | Japan | G03C 1/04 |
| 545014 | 7/1993 | Japan | G03C 1/04 |

*Primary Examiner*—Mark F. Huff

*Attorney, Agent, or Firm*—Sughrue, Mion, Zinn, Macpeak & Seas, PLLC

[57] ABSTRACT

A silver halide photographic material which comprises a support having thereon at least one silver halide emulsion layer, wherein the photographic material contains a hydrazine derivative and a polymer latex having a core/shell structure which each are incorporated in at least one of the silver halide emulsion layer and other hydrophilic colloid layers of the photographic material. The photographic material provides superhigh contrast images without impairing the physical properties of the film.

5 Claims, No Drawings

SILVER HALIDE PHOTOGRAPHIC MATERIAL

FIELD OF THE INVENTION

The present invention relates to a silver halide photographic material and, in particular, to a superhigh contrast silver halide photographic material for use in a photomechanical process.

BACKGROUND OF THE INVENTION

The addition of a hydrazine compound to a silver halide photographic emulsion and a developing solution is known by disclosures such as U.S. Pat. No. 3,730,727 (the developing solution comprising ascorbic acid and hydrazine), U.S. Pat. No. 3,227,552 (hydrazine is used as the auxiliary developing agent for obtaining a direct positive color image), U.S. Pat. No. 3,386,831 (the β-monophenylhydrazine of an aliphatic carboxylic acid is contained as a stabilizer for a silver halide photographic material), U.S. Pat. No. 2,419,975 and Mees, *The Theory of Photographic Process,* 3rd Ed. (1966), page 281.

Of the above, in particular, U.S. Pat. No. 2,419,975 discloses that a high contrast negative image can be obtained by the addition of a hydrazine compound.

U.S. Pat. No. 2,419,975 discloses that an extremely high contrast photographic characteristic of gamma (γ) exceeding 10 can be obtained by adding a hydrazine compound to a silver chlorobromide emulsion to prepare a photographic material and developing the material with a developing solution having very high pH of 12.8. However, such a strongly alkaline developing solution having pH of almost 13 is prone to be air oxidized, unstable and cannot endure long term storage or usage.

Various contrivances have been attempted to develop a silver halide photographic material containing a hydrazine compound with a developing solution having pH as small as possible to obtain a high contrast image.

There are disclosed in JP-A-1-179939 and JP-A-1-179940 (the term "JP-A" as used herein refers to a "published unexamined Japanese patent application") the processing method of developing a photographic material containing a nucleating development accelerator having an adsorptive group onto silver halide emulsion grains as well as a nucleating agent having an adsorptive group with a developing solution having pH of 11.0 or less. However, the compound having an adsorptive group, when added to a silver halide emulsion in the amount exceeding a certain limit, impairs sensitivity, inhibits development, or hinders the functions of other useful adsorptive additives, therefore, the amount used is limited and sufficient high contrast cannot be manifested.

JP-A-60-140340 discloses that high contrast is increased by the addition of amines to a silver halide photographic material. However, sufficient high contrast cannot be obtained when developing with the developing solution having pH of less than 11.0.

JP-A-56-106244 discloses the addition of an amino compound to the developing solution having pH of from 10 to 12 to accelerate contrast. However, when amines are added to a developing solution, the solution gives out a bad odor, the apparatus used is stained with the adhesion of smudges, further there arises a problem of the environmental pollution due to the waste solution. Therefore, it is desired to incorporate amines into a photographic material but sufficient performance cannot be obtained when added to a photographic material.

Also, gelatin is generally used as a binder for hydrophilic colloid layers constituting a silver halide photographic material, but such hydrophilic colloid layers are liable to expand and contract to humidity and temperature changes and are fragile under a low humid atmosphere.

For improving such drawbacks, a polymer latex is incorporated into hydrophilic colloid layers such as a silver halide emulsion layer, an interlayer, a protective layer and a backing layer.

For example, there are disclosed in U.S. Pat. Nos. 2,763,625, 2,852,382, JP-A-62-115152, JP-A-5-66512, JP-A-5-80449, JP-B-60-15935, JP-B-4-64058 and JP-B-5-45014 (the term "JP-B" as used herein refers to an "examined Japanese patent publication") the incorporation of a polymer latex comprising various monomers such as alkyl acrylate and alkyl methacrylate and so on into hydrophilic colloid layers. Further, JP-B-45-5819, JP-B-46-22507 and JP-A-50-73625 disclose that the strength of the gelatin film containing a latex at a wet state can be improved by the incorporation of a polymer latex obtained by copolymerizing a monomer having an active methylene group with a monomer such as alkyl acrylate into the gelatin film.

However, in the case where a hydrazine derivative is used for obtaining a high contrast image, the photographic material containing such a latex has some problems such that gradation of images become soft and the film strength at a wet state is not sufficient, and the improvement of these problems has been desired.

SUMMARY OF THE INVENTION

Accordingly, the object of the present invention is to provide a silver halide photographic material which provides superhigh contrast images without impairing the film physical properties.

The above object of the present invention has been achieved by a silver halide photographic material which comprises a support having thereon at least one silver halide emulsion layer, wherein the photographic material contains a hydrazine derivative and a polymer latex having a core/shell structure which are incorporated in the silver halide emulsion layer and/or other hydrophilic colloid layer. The layer in which the hydrazine derivative is incorporated and the layer in which the polymer latex having a core/shell structure incorporated may be the same layer or different layers.

The hydrazine derivative for use in the present invention is represented by the following formula (I):

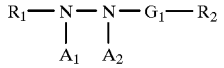

(I)

wherein $R_1$ represents an aliphatic group or an aromatic group; $R_2$ represents a hydrogen atom, an alkyl group, an aryl group, an unsaturated heterocyclic group, an alkoxyl group, an aryloxy group, an amino group or a hydrazino group; $G_1$ represents a —CO— group, an —$SO_2$— group, an —SO— group, a

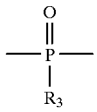

group, a —CO-CO— group, a thiocarbonyl group, or an iminomethylene group; $A_1$ and $A_2$ each represents a hydrogen atom, or either one represents a hydrogen atom and the other represents a substituted or unsubstituted alkylsulfonyl group, or a substituted or unsubstituted arylsulfonyl group, or a substituted or unsubstituted acyl group; and $R_3$ has the same meaning as the definition for $R_2$, and $R_3$ and $R_2$ may be the same or different.

In formula (I), the aliphatic group represented by $R_1$ is preferably an aliphatic group having from 1 to 30 carbon atoms, more preferably, a straight chain, branched or cyclic alkyl group having from 1 to 20 carbon a toms. The branched alkyl group herein may be cyclized so as to form a saturated heterocyclic ring containing one or more hetero atoms, and the alkyl group may have a substituent.

In formula (I), the aromatic group represented by $R_1$ is a monocyclic or bicyclic aryl group or an unsaturated heterocyclic group. The unsaturated heterocyclic group herein may form a hetero aryl group by condensation with a monocyclic or bicyclic aryl group, e.g., a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, etc., above all, those containing a benzene ring are preferred.

It is more preferred that $R_1$ represents an aryl group.

The aliphatic group or an aromatic group represented by $R_1$ may be substituted, and examples of the substituent include, e.g., an alkyl group, an alkenyl group, an alkynyl group, an aryl group, a group containing a heterocyclic ring, a pyridinium group, a hydroxyl group, an alkoxyl group, an aryloxy group, an acyloxy group, an alkylsulfonyloxy group, an arylsulfonyloxy group, an amino group, a carbonamido group, a sulfonamido group, a ureido group, a thioureido group, a semicarbazido group, a thiosemicarbazido group, a urethane group, a group having a hydrazido structure, a group having a quaternary ammonium structure, an alkylthio group, an arylthio group, an alkylsulfonyl group, an arylsulfonyl group, an alkylsulfinyl group, an arylsulfinyl group, a carboxyl group, a sulfo group, an acyl group, an alkoxycarbonyl group, an aryloxycarbonyl group, a carbamoyl group, a sulfamoyl group, a halogen atom, a cyano group, a phosphoric acid amido group, a diacylamino group, an imido group, a group having an acylurea structure, a group containing a selenium atom or a tellurium atom, and a group having a tertiary sulfonium structure or a quaternary sulfonium structure, and preferred substituents are a straight chain, branched or cyclic alkyl group (preferably an alkyl having from 1 to 20 carbon atoms), an aralkyl group (preferably a monocyclic or bicyclic group having an alkyl moiety containing from 1 to 3 carbon atoms), an alkoxyl group (preferably an alkoxyl group having from 1 to 20 carbon atoms), a substituted amino group (preferably an amino group substituted with an alkyl group having from 1 to 20 carbon atoms), an acylamino group (preferably an acylamino group having from 2 to 30 carbon atoms), a sulfonamido group (preferably a sulfonamido group having from 1 to 30 carbon atoms), a ureido group (preferably a uredo group having from 1 to 30 carbon atoms), and a phosphoric acid amido group (preferably a phosphoric acid amido group having from 1 to 30 carbon atoms).

In formula (I), the alkyl group represented by $R_2$ is preferably an alkyl group having from 1 to 4 carbon atoms, and the aryl group is preferably a monocyclic or bicyclic aryl group, for example, those having a benzene ring.

The heterocyclic group represented by $R_2$ is a 5- or 6-membered compound containing at least one of a nitrogen atom, an oxygen atom and a sulfur atom, e.g., an imidazolyl group, a pyrazolyl group, a triazolyl group, a tetrazolyl group, a pyridyl group, a pyridinium group, a quinolinium group, or a quinolinyl group, and a pyridyl group or a pyridinium group is particularly preferred.

The alkoxyl group represented by $R_2$ is preferably an alkoxyl group having from 1 to 8 carbon atoms; the aryloxy group represented by $R_2$ is preferably a monocyclic aryloxy group; and the amino group represented by $R_2$ is preferably an unsubstituted amino group, an alkylamino group having from 1 to 10 carbon atoms, or an arylamino group.

$R_2$ may be substituted and preferred substituents include the same substituents as set forth for $R_1$.

Of the groups represented by $R_2$, preferred groups are, when $G_1$ represents a —CO— group, a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl), an aryl group (e.g., phenyl, 3,5-dichlorophenyl, o-methanesulfonamidophenyl, 4-methane-sulfonylphenyl, 2-hydroxymethylphenyl), etc.

Further, when $G_1$ represents an —$SO_2$— group, $R_2$ preferably represents an alkyl group (e.g., methyl), an aralkyl group (e.g., o-hydroxybenzyl), an aryl group (e.g., phenyl), or a substituted amino group (e.g., dimethylamino).

When $G_1$ represents a —COCO— group, $R_2$ preferably represents an alkoxyl group, an aryloxy group or an amino group.

In formula (I), $G_1$ preferably represents a —CO— group or a —COCO— group, and most preferably a —CO— group.

In addition, $R_2$ may be a group which releases the $G_1$—$R_2$ moiety from the remainder of the molecule and undergoes a cyclization reaction to form a cyclic structure containing the atom of the $G_1$—$R_2$ moiety, and one example thereof is disclosed in JP-A-63-29751.

In formula (I), $A_1$ and $A_2$ each represents a hydrogen atom, or either one represents a hydrogen atom and the other represents an alkyl- or arylsulfonyl group having 20 or less carbon atoms (preferably a phenylsulfonyl group, or a phenylsulfonyl group substituted so as to provide a sum of Hammett's sigma values of −0.5 or more) or an acyl group having 20 or less carbon atoms (preferably a benzoyl group, a benzoyl group substituted so as to provide a sum of Hammett's sigma values of −0.5 or more, or a straight chain, branched or cyclic, substituted or unsubstituted aliphatic acyl group (specific examples of such substituents include a halogen atom, an ether group, a sulfonamido group, a carbonamido group, a hydroxyl group, a carboxyl group, and a sulfonic acid group)).

$A_1$ and $A_2$ are most preferably a hydrogen atom.

The substituents for $R_1$ and $R_2$ in formula (I) may further be substituted, and preferred substituents include the same substituents as set forth for $R_1$. Substituents may be substituted multiple times, that is, substituents, substituents of the substituents, substituents of the substituents of the substituents . . . , and preferred substituents are also those cited as substituents for $R_1$.

$R_1$ or $R_2$ in formula (I) may include a ballast group or a polymer which are normally used in immobile photographic additives such as couplers. Such a ballast group has 8 or more carbon atoms and is a group which is photographically comparatively inactive and can be selected from, for example, an alkyl group, an aralkyl group, an alkoxyl group, a phenyl group, an alkylphenyl group, a phenoxy group and an alkyl-phenoxy group. Further, those disclosed, for example, in JP-A-1-100530 can be cited as such a polymer.

$R_1$ or $R_2$ in formula (I) may include therein a group which promotes the adsorption of the compound represented by formula (I) onto the surface of silver halide grains. Examples of such adsorptive groups include an alkylthio group, an arylthio group, a thiourea group, a heterocyclic thioamido group, a heterocyclic mercapto group, and a triazole group as disclosed in U.S. Pat. Nos. 4,385,108, 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246.

The preferred hydrazine derivative for use in the present invention is a hydrazine derivative in which $R_1$ represents a phenyl group having a ballast group, a group which accelerates adsorption onto the surface of silver halide grains, a group having a quaternary ammonium structure or an alkylthio group, via a sulfonamido group, an acylamino group or a ureido group, $G_1$ represents a —CO— group, and $R_2$ represents a hydrogen atom, a substituted alkyl group, or a substituted aryl group (preferred substituents include an electron attractive group or a hydroxymethyl group at the 2-position). In addition, any combinations of the selection from the above $R_1$ and $R_2$ are possible and preferred.

Further, in the present invention, a hydrazine derivative which has, in the vicinity of the hydrazine group, an anionic group or a nonionic group which forms an intramolecular hydrogen bond with the hydrogen atom of the hydrazine is preferably used.

Specific examples of such anionic groups include carboxylic acid, sulfonic acid, sulfinic acid, phosphoric acid, phosphonic acid and the salts thereof. "In the vicinity of the hydrazine group" used herein means that a bonding chain comprising from 2 to 5 atoms selected from at least one kind of a carbon atom, a nitrogen atom, an oxygen atom and a sulfur atom intervenes between the nitrogen atom near the anionic group of the hydrazine and the anionic group.

More preferred as the vicinity is the case where a bonding chain comprising from 2 to 5 atoms selected from at least one kind of a carbon atom and a nitrogen atom intervenes, and more preferably the case where a bonding chain comprising from 2 to 3 carbon atoms intervenes. The nonionic group which forms a hydrogen bond together with the hydrogen atom of the hydrazine is a group which has a lone electron pair and is capable of forming a 5-, 6- or 7-membered ring along with the lone electron pair and the hydrogen bond between the lone electron pair and the hydrogen atom of the hydrazine. Therefore, the nonionic group contains at least one of an oxygen atom, a nitrogen atom, a sulfur atom and a phosphorus atom. Examples of the nonionic group include an alkoxy group, an amino group, an alkylthio group, a carbonyl group, a carbamoyl group, an alkoxycarbonyl group, a urethane group, a ureido group, an acyloxy group and an acylamino group.

Of these, an anionic group is preferred, and carboxylic acid and the salt thereof are most preferred. The nucleating agents preferably used in the present invention are represented by the following formulae (1) to (3).

(1)

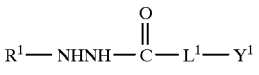

wherein $R^1$ represents an alkyl group, an aryl group or a heterocyclic group; $L^1$ represents a divalent linking group having an electron attractive group; and $Y^1$ represents an anionic group, or a nonionic group which forms an intramolecular hydrogen bond with the hydrogen atom of the hydrazine.

(2)

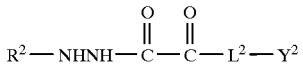

wherein $R^2$ represents an alkyl group, an aryl group or a heterocyclic group; $L^2$ represents a divalent linking group; and $Y^2$ represents an anionic group, or a nonionic group which forms an intramolecular hydrogen bond with the hydrogen atom of the hydrazine.

(3)

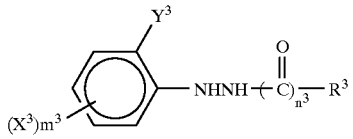

wherein $X^3$ represents a group which is capable of bonding to a benzene ring as a substituent; $R^3$ represents an alkyl group, an alkenyl group, an alkynyl group, an aryl group, a heterocyclic group, an alkoxyl group or an amino group; $Y^3$ represents an anionic group, or a nonionic group which forms an intramolecular hydrogen bond with the hydrogen atom of the hydrazine; $m^3$ represents an integer of from 0 to 4; and $n^3$ represents an integer of 1 or 2, and when $n^3$ is 1, $R^3$ has an electron attractive group.

Formulae (1) to (3) are further explained in detail below.

The alkyl group represented by $R^1$ and $R^2$ is a straight chain, branched chain or cyclic alkyl group having from 1 to 16, preferably from 1 to 12, carbon atoms, e.g., methyl, ethyl, propyl, isopropyl, t-butyl, allyl, propargyl, 2-butenyl, 2-hydroxyethyl, benzyl, benzhydryl, trityl, 4-methylbenzyl, 2-methoxyethyl, cyclopentyl, or 2-acetamidoethyl.

The aryl group represented by $R^1$ and $R^2$ is an aryl group having from 6 to 24, preferably from 6 to 12, carbon atoms, e.g., phenyl, naphthyl, p-alkoxyphenyl, p-sulfonamidophenyl, p-ureidophenyl, or p-amidophenyl. The heterocyclic group represented by $R^1$ and $R^2$ is a 5- or 6-membered saturated or unsaturated heterocyclic ring having from 1 to 5 carbon atoms and containing one or more of an oxygen atom, a nitrogen atom or a sulfur atom, and the number and the kind of the hetero atom constituting the ring may be one or more, e.g., 2-furyl, 2-thienyl or 4-pyridyl.

$R^1$ and $R^2$ each preferably represent an aryl group, an aromatic heterocyclic group or an aryl-substituted methyl group, and more preferably an aryl group (e.g., phenyl, naphthyl). $R^1$ and $R^2$ may be substituted, and examples of the substituents include, e.g., an alkyl group, an aralkyl group, an alkoxyl group, an alkyl- or aryl-substituted amino group, an amido group, a sulfonamido group, a ureido group, a urethane group, an aryloxy group, a sulfamoyl group, a carbamoyl group, an aryl group, an alkylthio group, an arylthio group, a sulfonyl group, a sulfinyl group, a hydroxyl group, a halogen atom, a cyano group, a sulfo group, a carboxyl group, and a phosphoric acid amido group. These substituents may further be substituted. Preferred examples include a sulfonamido group, a ureido group, an amido group, an alkoxyl group and a urethane group, with a sulfonamido group and a ureido group being more preferred. These groups may be bonded to each other to form a ring, if possible.

As for the alkyl group, the aryl group and the heterocyclic group represented by $R^3$, those as described for $R^1$ can be cited. The alkenyl group represented by $R^3$ preferably has from 2 to 18, more preferably from 2 to 10, carbon atoms, e.g., vinyl and 2-styryl. The alkynyl group represented by $R^3$ has preferably from 2 to 18, preferably from 2 to 10, carbon atoms, e.g., ethynyl and phenylethynyl. The alkoxyl group represented by $R^3$ is preferably a straight chain, branched chain or cyclic alkoxyl group having from 1 to 16, more preferably from 1 to 10, carbon atoms, e.g., methoxy, isopropoxy and benzyloxy. The amino group represented by $R^3$ preferably has from 0 to 16, more preferably from 1 to 10, carbon atoms, e.g., ethylamino, benzylamino and phenylamino. When $n^3$ is 1, it is preferred that $R^3$ represents an alkyl group, an alkenyl group or an alkynyl group. When $n^3$ is 2, it is preferred that $R^3$ represents an amino group or an alkoxyl group.

The electron attractive group which $R^3$ has is preferably a group having Hammett's am value of 0.2 or more, more preferably 0.3 or more, e.g., a halogen atom (fluorine, bromine, iodine), a cyano group, a sulfonyl group (methanesulfonyl, benzenesulfonyl), a sulfinyl group (methanesulfinyl), an acyl group (acetyl, benzoyl), an oxycarbonyl group (methoxycarbonyl), a carbamoyl group (N-methylcarbamoyl), a sulfamoyl group (methylsulfamoyl), a halogen-substituted alkyl group (trifluoromethyl), a heterocyclic group (2-benzoxazolyl, pyrrolo), or a quaternary onium group (triphenylphosphonium, trialkylammonium, pyridinium). Examples of $R^3$ having an electron attractive group include trifluoromethyl, difluoromethyl, pentafluoroethyl, cyanomethyl, methanesulfonylmethyl, acetylethyl, trifluoromethylethynyl, or ethoxycarbonylmethyl.

$L^1$ and $L^2$ represent a divalent linking group, e.g., an alkylene group, an alkenylene group, an alkynylene group, an arylene group, or a divalent heterocyclic group or a group connecting them with an —O—, —S—, —NH—, —CO—, or —$SO_2$— group alone or in combination. $L^1$ and $L^2$ may be substituted with groups described as substituents for $R^1$. As the alkylene group, e.g., methylene, ethylene, trimethylene, propylene, 2-buten-1,4-yl, and 2-butyn-1,4-yl are preferred. As the alkenylene group, vinylene is preferred. As the alkynylene group, ethynylene is preferred. As the arylene group, phenylene is preferred. As the divalent heterocyclic group, furan-1,4-diyl is preferred. As $L^1$, an alkylene group, an alkenylene group, an alkynylene group or an arylene group is preferred, an alkylene group is more preferred, and an alkylene group having a chain length of from 2 to 3 carbon atoms is most preferred. As $L^2$, an alkylene group, an arylene group, —NH-alkylene-, —O-alkylene-, —NH-arylene- are preferred, and —NH-alkylene- and —O-alkylene- are more preferred.

The electron attractive group, which $L^1$ can have, can be selected from the electron attractive groups described for $R^3$. Specific examples of substituents for $L^1$ include, e.g., tetrafluoroethylene, fluoromethylene, hexafluorotrimethylene, perfluorophenylene, difluorovinylene, cyanomethylene, and methanesulfonylethylene.

As for $Y^1$, $Y^2$ and $Y^3$, as are already described, an anionic group or a nonionic group having a lone electron pair and being capable of forming a 5- , 6- or 7-membered ring along with the hydrogen bond between the lone electron pair and the hydrogen atom of the hydrazine. Examples of the anionic group include carboxylic acid, sulfonic acid, sulfinic acid, phosphoric acid, phosphonic acid and the salts thereof. As the salt, an alkali metal ion (sodium, potassium), an alkaline earth metal ion (calcium, magnesium), ammonium (ammonium, triethylammonium, tetrabutylammonium, pyridinium), phosphonium (tetraphenylphosphonium) can be cited. Examples of the nonionic group include a group which has at least one of an oxygen atom, a nitrogen atom, a sulfur atom or a phosphorus atom, e.g., an alkoxyl group, an amino group, an alkylthio group, a carbonyl group, a carbamoyl group, an alkoxycarbonyl group, a urethane group, a ureido group, an acyloxy group, and an acylamino group. $Y^1$, $Y^2$ and $Y^3$ each preferably represents an anionic group, more preferably carboxylic acid and the salt thereof.

Preferred examples of the group which can be substituted on a benzene ring represented by $X^3$ include the substituents which $R^1$ in formula (1) may have. When $m^3$ is 2 or more, each group may be the same or different.

$R^1$, $R^2$, $R^3$ or $X^3$ may have a nondiffusible group which is used for photographic couplers, or may have a group which accelerates adsorption to silver halide (hereinafter an adsorption accelerating group). A nondiffusible group is a group having from 8 to 30, preferably from 12 to 25, carbon atoms. The adsorption accelerating group is preferably a 5- or 6-membered nitrogen-containing heterocyclic group (e.g., benzotriazole) which forms thioamidos (e.g., thiourethane, thioureido, thioamido), mercaptos (e.g., heterocyclic mercapto such as 5-mercaptotetrazole, 3-mercapto-1,2,4-triazole, 2-mercapto-1,3,4-thiadiazole, and 2-mercapto-1,3,4-oxadiazole, alkylmercapto, arylmercapto) and imino silvers. Those having an adsorption accelerating group may have such a structure that the adsorption accelerating group is protected and the protective group is removed at the time of development processing and the adsorption to silver halide is heightened.

In formulae (1) to (3), the hydrogen atoms of each two compounds may be removed and the radicals may be bonded to form a bis-type.

Of formulae (1) to (3), formulae (1) and (2) are preferred and formula (1) is more preferred. Further, in formulae (1) to (3), the following formulae (4) to (6) are more preferred and formula (4) is most preferred.

(4)

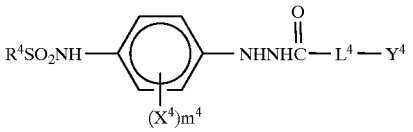

wherein $R^4$, $X^4$ and $m^4$ each has the same meaning as $R^3$, $X^3$ and $m^3$ in formula (3), respectively, and $L^4$ and $Y^4$ each has the same meaning as $L^1$ and $Y^1$ in formula (1), respectively.

(5)

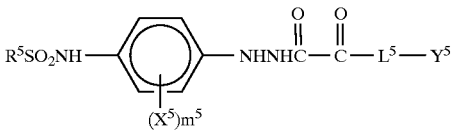

wherein $R^5$, $X^5$ and $m^5$ each has the same meaning as $R^3$, $X^3$ and $m^3$ in formula (3), respectively, and $L^5$ and $Y^5$ each has the same meaning as $L^2$ and $Y^2$ in formula (2), respectively.

(6)
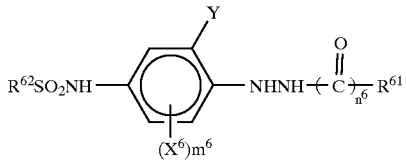
wherein $R^{61}$, $R^{62}$, $X^6$, $m^6$, $n^6$and Y each has the same meaning as $R^3$, $R^3$, $X^3$, $m^3$, $n^3$ and $Y^3$ in formula (3), respectively.
Specific examples of the hydrazine derivatives for use in the present invention are shown below, but the present invention is not limited to them.
I-1
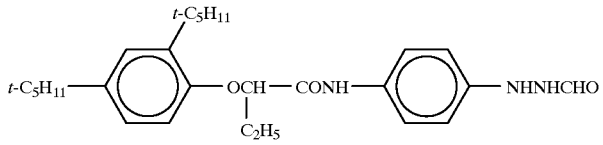
I-2
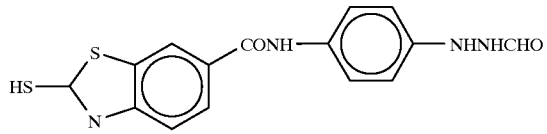
I-3
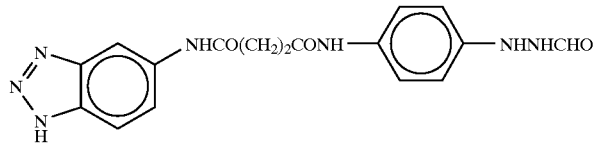
I-4
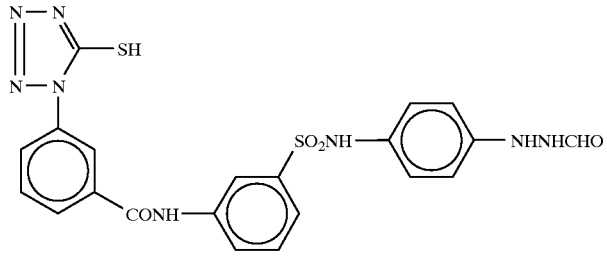
I-5
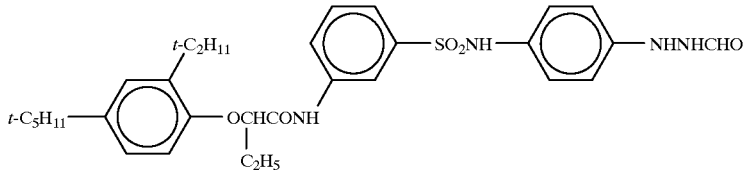
I-6
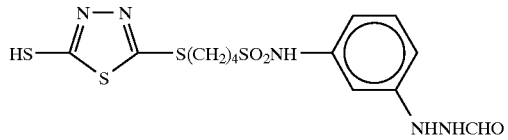

-continued
I-7
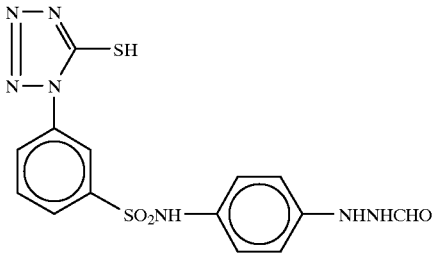
I-8
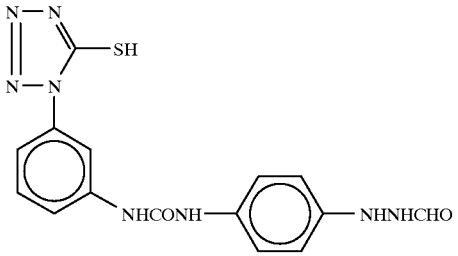
I-9
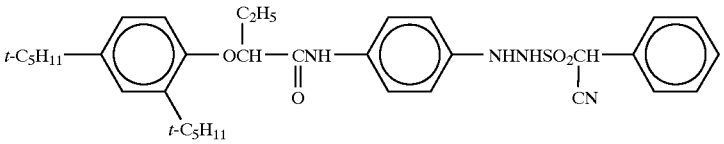
I-10
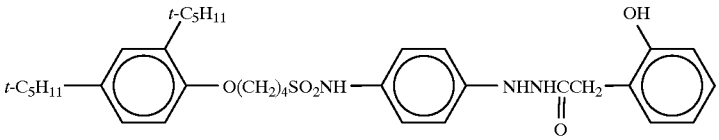
I-11
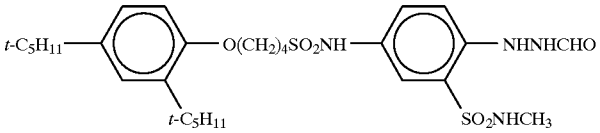
I-12
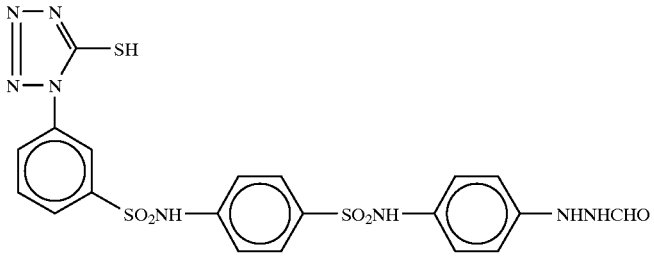
I-13
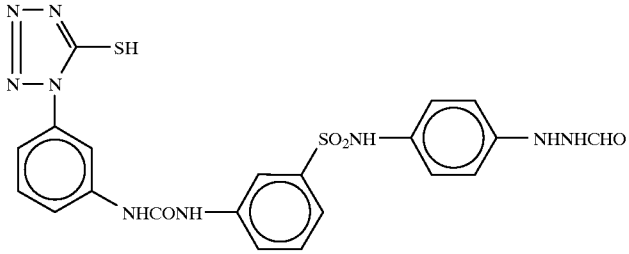

-continued
I-14
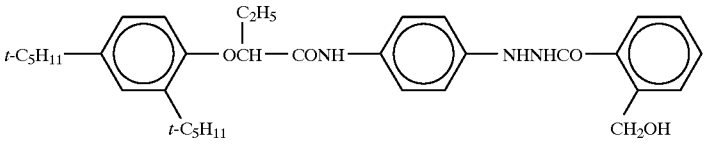
I-15
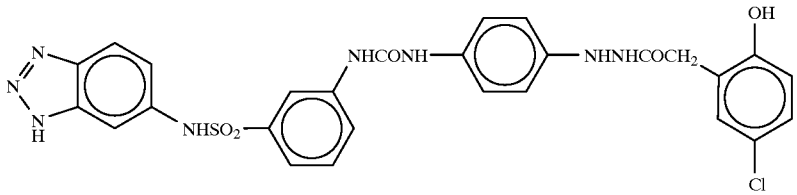
I-16
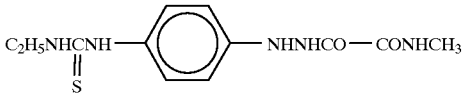
I-17
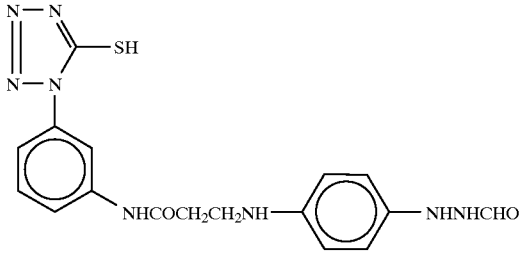
I-18
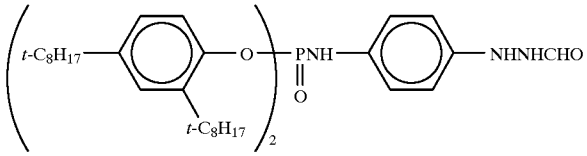
I-19
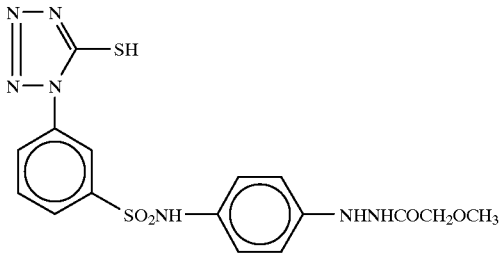
I-20
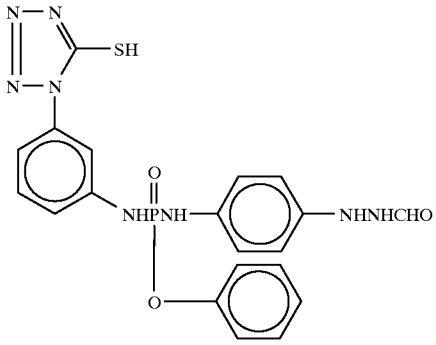

-continued
I-21
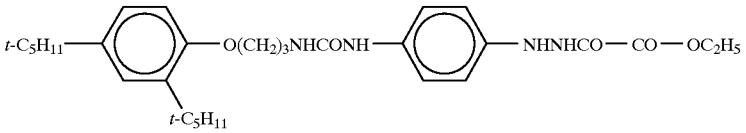
I-22
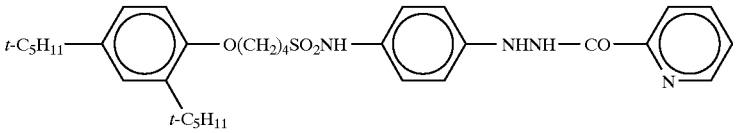
I-23
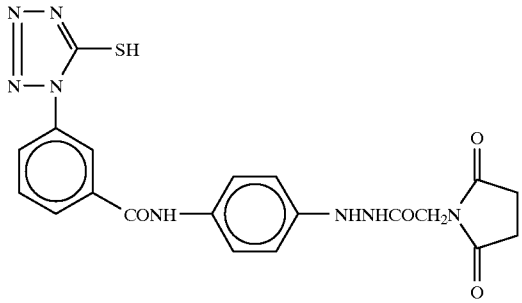
I-24
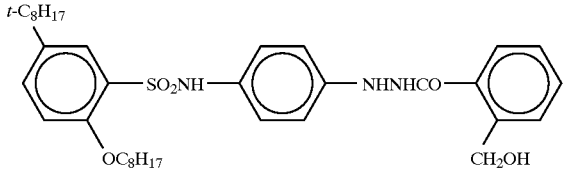
I-25
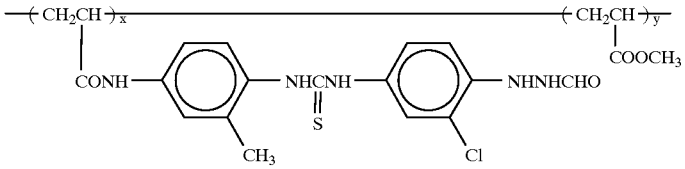
x/y = 3/97
average molecular weight: about 100,000
I-26
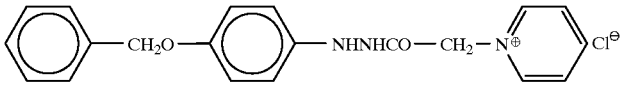
I-27
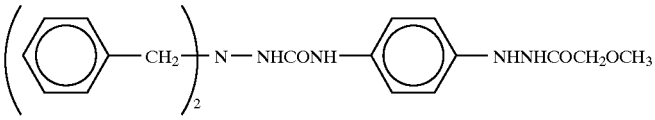
I-28
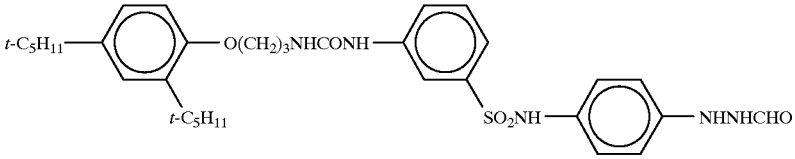

-continued
I-29
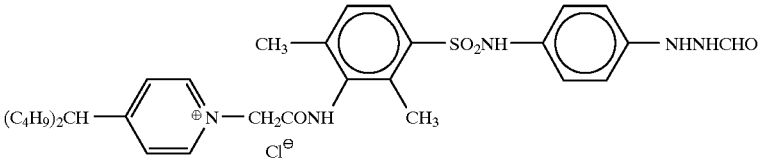
I-30
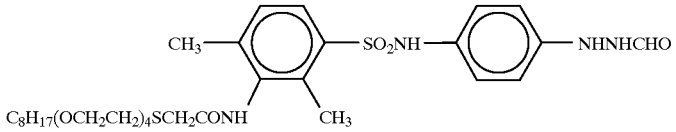
I-31
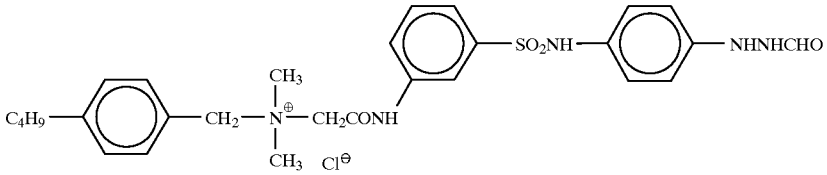
I-32
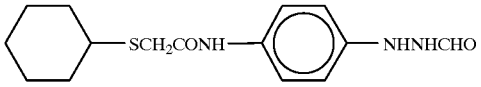
I-33
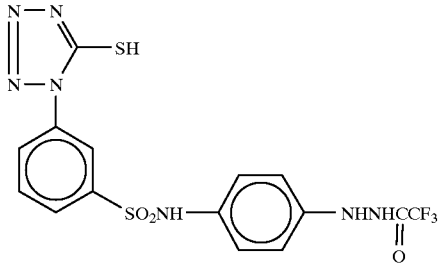
I-34
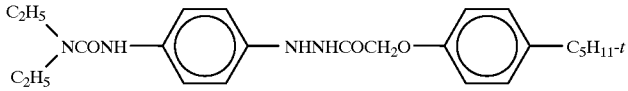
I-35
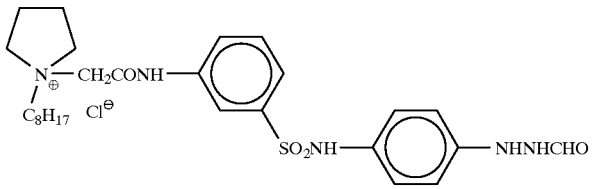
I-36
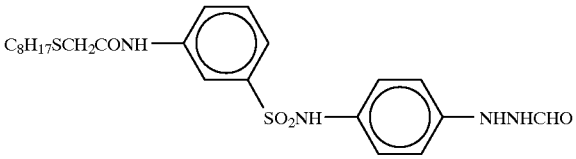
I-37
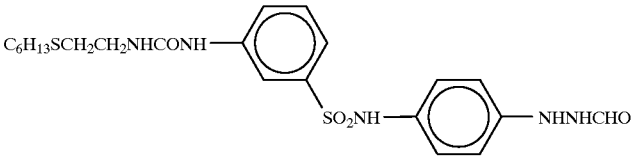

-continued
I-38
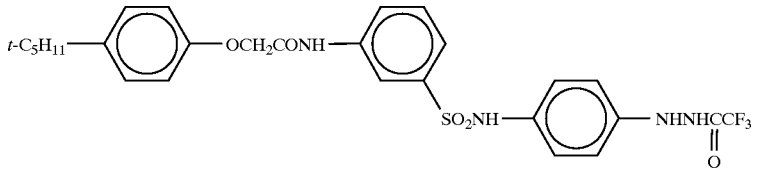
I-39
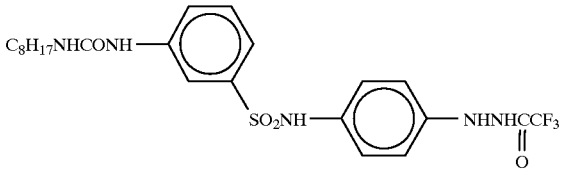
I-40
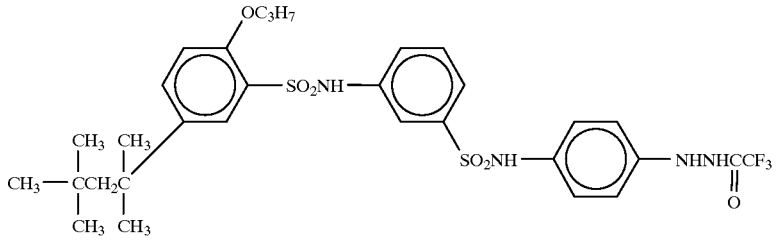
I-41
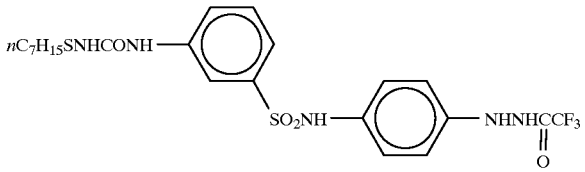
I-42
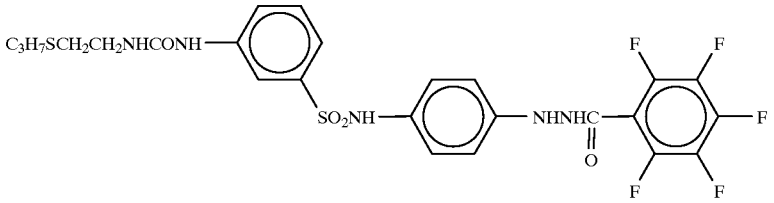
I-43
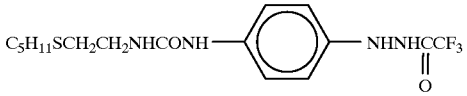
I-44
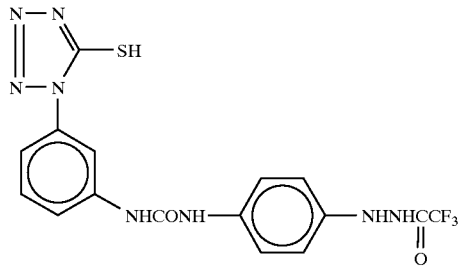
I-45
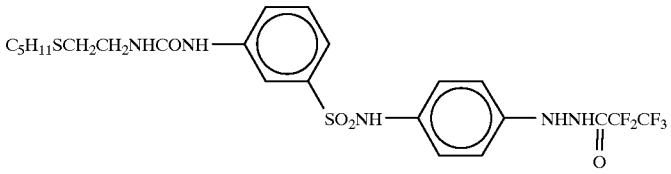

-continued
I-46
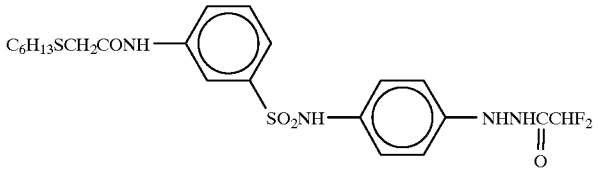
I-47
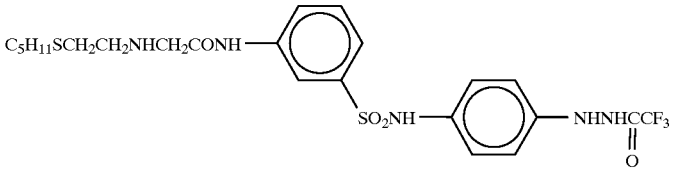
I-48
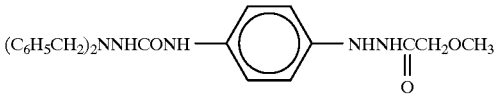
I-49
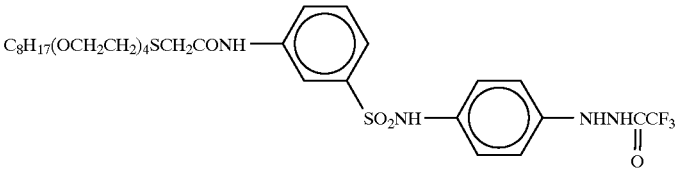
I-50
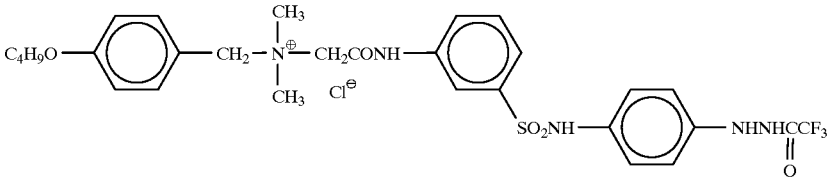
I-51
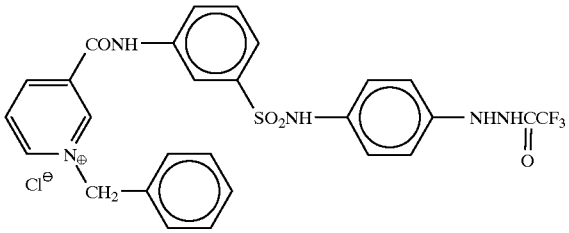
I-52
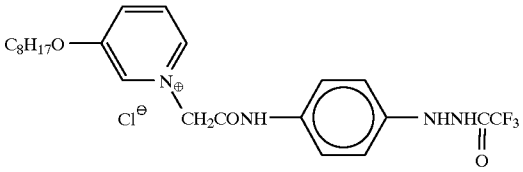
I-53
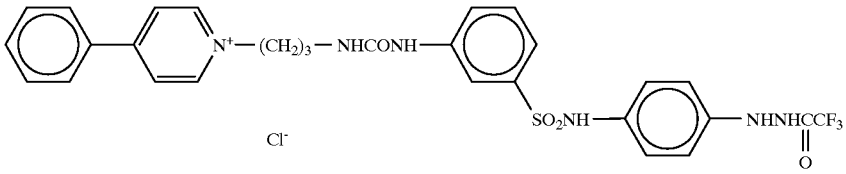

-continued
I-54
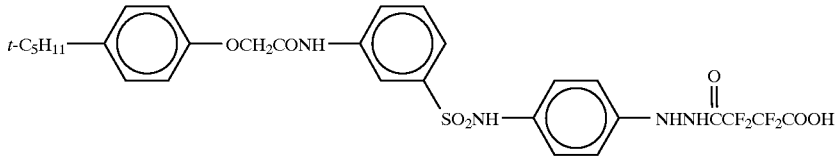
I-55
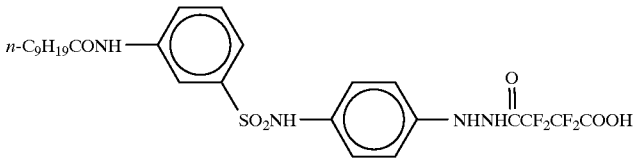
I-56
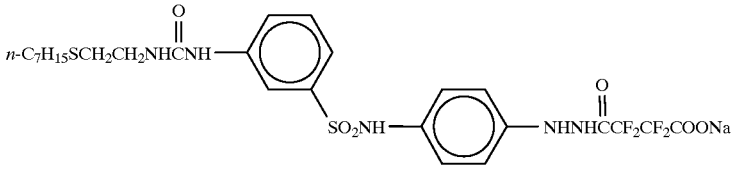
I-57
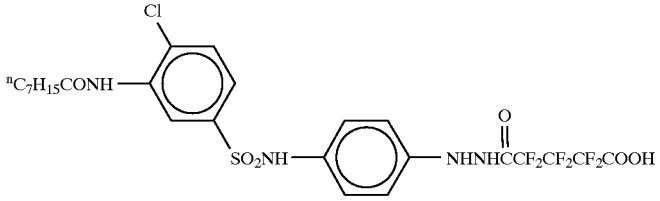
I-58
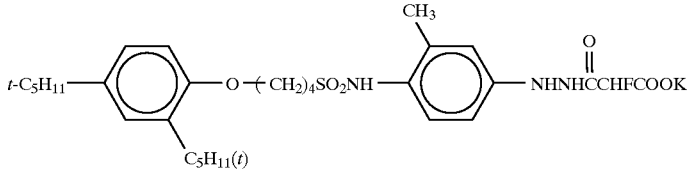
I-59
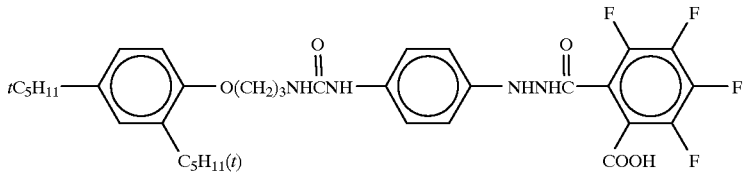
I-60
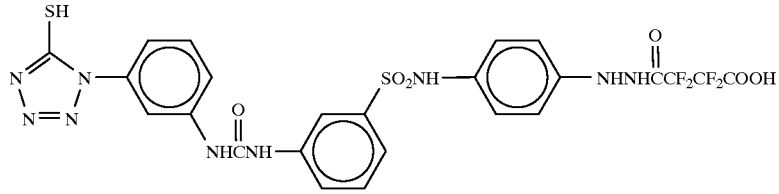
I-61
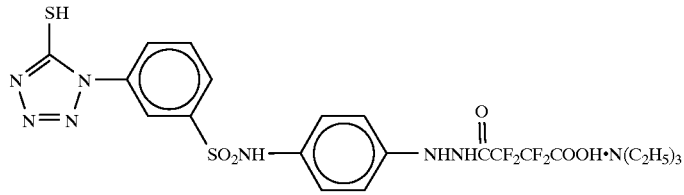

-continued
I-62
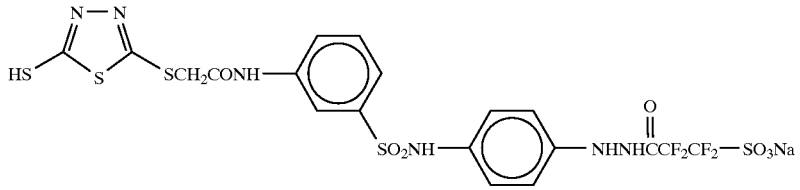
I-63
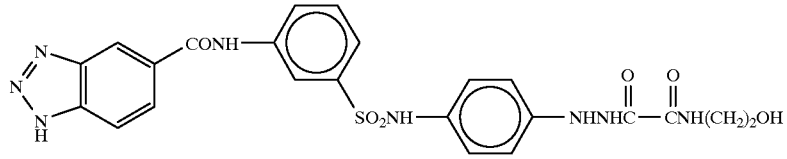
I-64
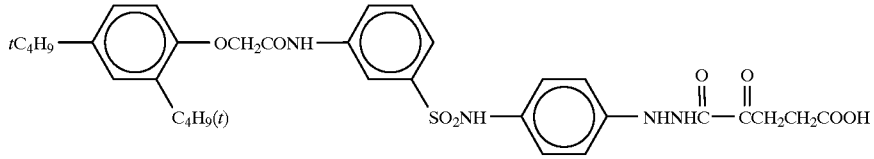
I-65
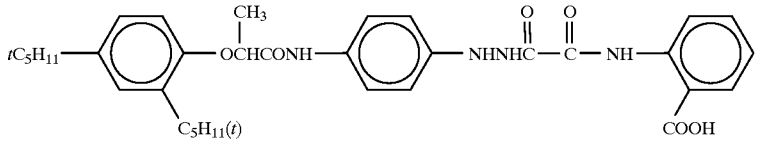
I-66
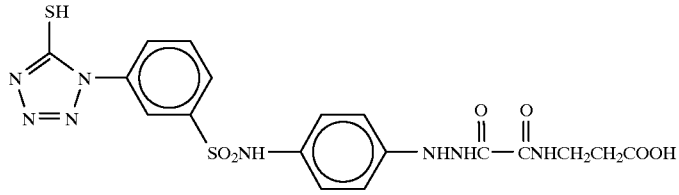
I-67
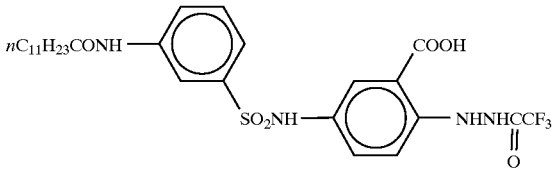
I-68
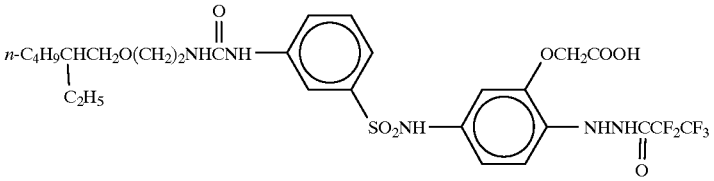
I-69
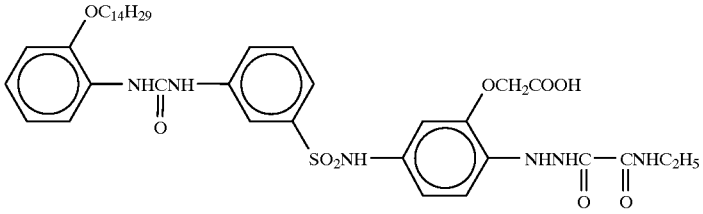

-continued
I-70
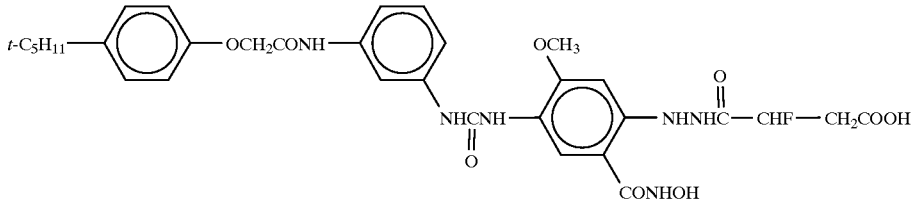
I-71
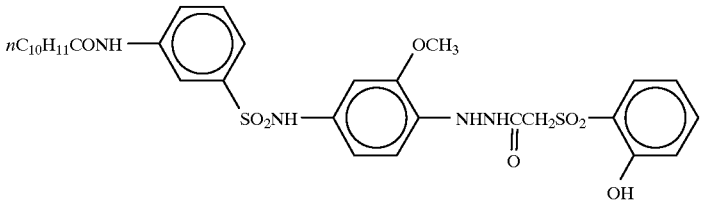
I-72
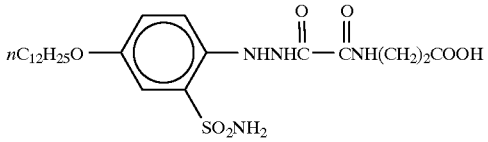
I-73
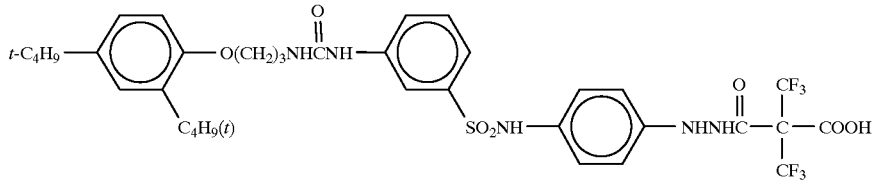
I-74
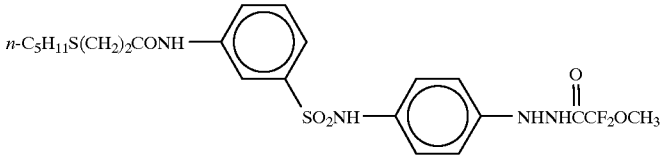
I-75
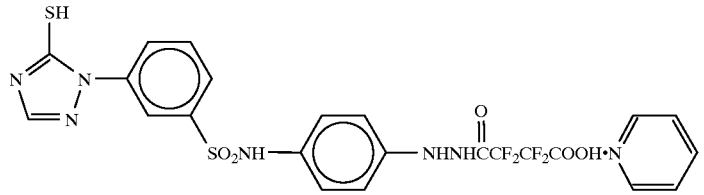
I-76
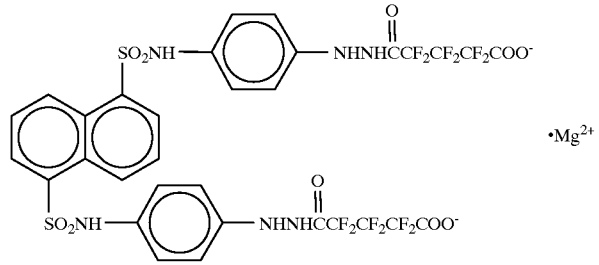
I-77
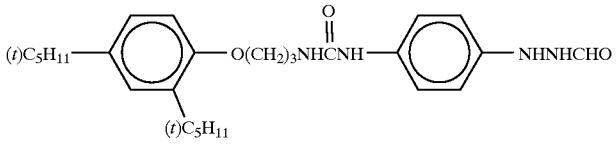

-continued

I-78

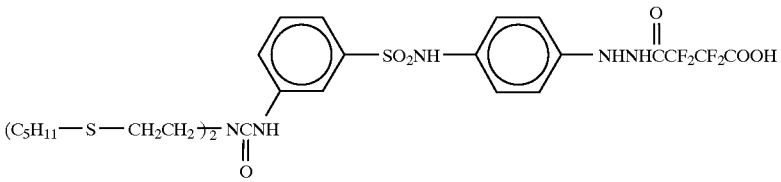

I-79

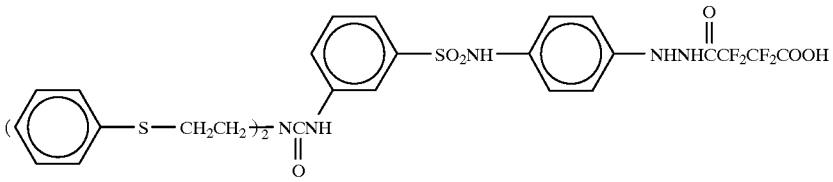

I-80

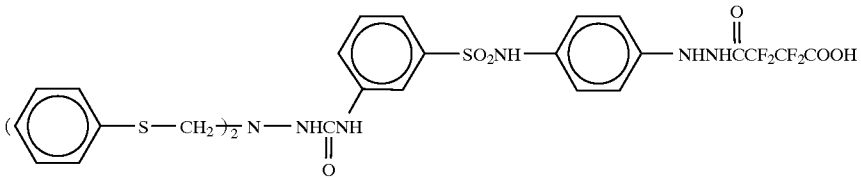

I-81

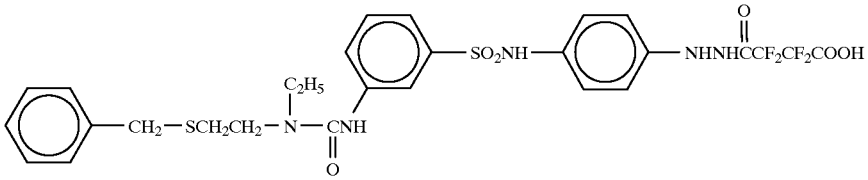

I-82

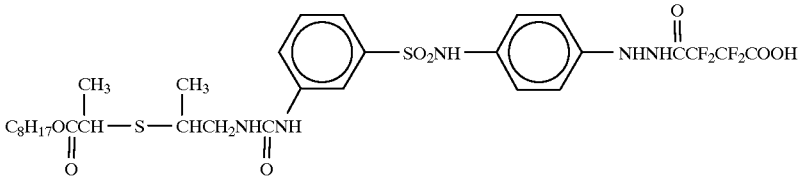

I-83

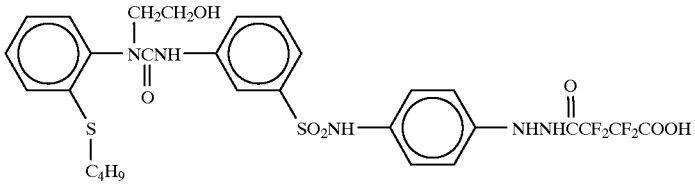

I-84

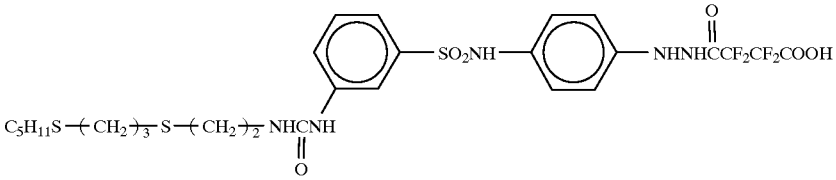

As the hydrazine derivatives which can be used in the present invention, in addition to the compounds shown above, those disclosed in *Research Disclosure*, Item 23516 (November, 1983, p. 346) and the literature cited therein, U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, 5,104,769, British Patent 2,011,391B, EP 217310, EP 301799, EP 356898, JP-A-60-179734, JP-A-61-170733, JP-A-61-270744, JP-A-62-178246,JP-A-62-270948, JP-A-63-29751, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764, JP-A-5-45765, and JP-A-6-289524 can be cited.

The amount of hydrazine derivatives used in the present invention is preferably from $1\times10^{-6}$ mol to $5\times10^{-2}$ mol, and particularly preferably from $1\times10^{-5}$ mol to $2\times10^{-2}$ mol, per mol of silver halide.

The hydrazine derivatives of the present invention can be used in the form of a solution in an appropriate organic solvent miscible with water, such as alcohols (e.g., methanol, ethanol, propanol, fluorinated alcohol), ketones (e.g., acetone, methyl ethyl ketone), dimethylformamide, dimethyl sulfoxide, and methyl cellusolve.

Further, the hydrazine derivatives of the present invention can also be used in the form of an emulsion dispersion mechanically prepared according to well known emulsifying dispersion methods by dissolving using oils such as dibutyl phthalate, tricresyl phosphate, glyceryl triacetate or diethyl phthalate, or auxiliary solvents such as ethyl acetate and cyclohexanone, or they can be used in the form of a dispersion prepared according to a method known as a solid dispersion method in which powders of hydrazine derivatives are dispersed in water using a ball mill, a colloid mill or ultrasonic wave.

Further, the hydrazine derivatives of the present invention can also be used incorporated in polymer fine grains as disclosed in JP-A-2-948.

The polymer latexes having a core/shell structure of the present invention are explained below.

The cores which constitute the latexes of the present invention are specifically polymers comprising one or two or more repeating units of variously polymerizable ethylenically unsaturated monomers.

As such monomers, acrylic esters, methacrylic esters, vinyl esters, olefins, dienes, acrylamides, methacrylamides, vinyl ethers, and other various ethylenically unsaturated monomers can be used, further, monomers having two or more ethylenically unsaturated groups can also be preferably used.

Specific examples of acrylic esters include methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxy-propyl acrylate, 2-methoxyethyl acrylate, 3-methoxybutyl acrylate, 2-ethoxyethyl acrylate, 2-isopropoxy acrylate, 2-butoxyethyl acrylate, 2-(2-methoxyethoxy)ethyl acrylate, 2-(2-butoxyethoxy)ethyl acrylate, ω-methoxypolyethylene glycol acrylate (addition mol number: n=9), 1-bromo-2-methoxyethyl acrylate, and 1,1-dichloro-2-ethoxyethyl acrylate.

Specific examples of methacrylic esters include methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-butoxyethoxy) ethyl methacrylate, and allyl methacrylate.

Specific. examples of vinyl esters include vinyl acetate, vinyl propionate, vinyl butyrate, vinyl isobutyrate, vinyl caproate, vinyl chloroacetate, vinyl methoxyacetate, vinyl phenylacetate, vinyl benzoate, and vinyl salicylate.

Specific examples of conjugated diene monomers include 1,3-butadiene, isoprene, 1,3-pentadiene, 2-ethyl-1,3-butadiene, 2-n-propyl-1,3-butadiene, 2,3-dimethyl-1,3-butadiene, 2-methyl-1,3-pentadiene, 1-phenyl-1,3-butadiene, 1-α-naphthyl-1,3-butadiene, 1-β-naphthyl-1,3-butadiene, 2-chloro-1,3-butadiene, 1-bromo-1,3-butadiene, 1-chlorobutadiene, 2-fluoro-1,3-butadiene, 2,3-dichloro-1,3-butadiene, 1,1,2-trichloro-1,3-butadiene and 2-cyano-1,3-butadiene.

In addition to the above monomers, those which can be used in the present invention include:

Acrylamides, e.g., acrylamide, ethylacrylamide, tert-butylacrylamide, cyclohexylacrylamide, benzylacrylamide, hydroxymethylacrylamide, phenylacrylamide, dimethylacrylamide, diethylacrylamide, and diacetoneacrylamide;

Methacrylamides, e.g., methacrylamide, ethylmethacrylamide, tert-butylmethacrylamide, benzylmethacrylamide, hydroxymethylmethacrylamide, phenylmethacrylamide, and dimethylmethacrylamide;

Olefins, e.g., ethylene, propylene, 1-butene, 1-pentene, vinyl chloride, vinylidene chloride;

Styrenes, e.g., styrene, methylstyrene, ethylstyrene, chloromethylstyrene, methoxystyrene, acetoxystyrene, chlorostyrene, dichlorostyrene, bromostyrene, and vinylbenzoate methyl ester;

Vinyl ethers, e.g., methyl vinyl ether, butyl vinyl ether, hexyl vinyl ether, and methoxyethyl vinyl ether;

Other than the above, butyl crotonate, hexyl crotonate, dimethyl itaconate, dimethyl maleate, dibutyl maleate, diethyl fumarate, dimethyl fumarate, methyl vinyl ketone, phenyl vinyl ketone, methoxyethyl vinyl ketone, N-vinylpyrrolidone, acrylonitrile, methacrylonitrile, methylenemalonenitrile, vinylidene chloride, acrylic acid, methacrylic acid, itaconic acid, maleic acid, maleic anhydride, vinylsulfonic acid, 2-acrylamido-2-methylpropanesulfonic acid, and styrenesulfonic acid can be included.

The monomers having at least two copolymerizable ethylenically unsaturated groups can be used as the cores of the latexes of the present invention.

Examples of such monomers include divinylbenzene, ethylene glycol diacrylate, ethylene glycol dimethacrylate, diethylene glycol diacrylate, diethylene glycol dimethacrylate, triethylene glycol diacrylate, triethylene glycol dimethacrylate, trivinylcyclohexane, trimethylolpropanetriacrylate, trimethylolpropanetrimethacrylate, pentaerythritoltriacrylate, pentaerythritolmethacrylate, pentaerythritoltetraacrylate, and pentaerythritoltetramethacrylate.

The above enumerated monomers can be used alone or two or more monomers may be copolymerized. From the easiness of polymerization and the formation of core/shell structures, preferred examples of the monomer include acrylic esters, methacrylic esters, vinyl esters, conjugated dienes, styrenes, and monomers having two or more ethylenically unsaturated groups.

Of the above described core polymers, particularly preferred are those produced by emulsion polymerization and present in the form of fine grain dispersion (latex) in an aqueous medium.

In such a dispersion, core polymers are present in the form of fine grains.

The grain size of these polymers affects the physical properties of the film comprising the polymer along with gelatin, the stability in aqueous dispersion per se, and the film forming ability, therefore, too large a grain size is not preferred.

From the above description, the number-average grain size of the core polymers is preferably 1.0 μm or less, more preferably 0.7 μm or less, and most preferably 0.5 μm or less. The lower limit is preferably 0.00001 μm or more.

The shell part of the core/shell latex of the present invention will be explained below.

The shell part of the core/shell latex of the present invention may comprise any polymer but preferably polymers having repeating units derived from ethylenically unsaturated monomers having at least one active methylene group represented by the following formula (I):

(I)

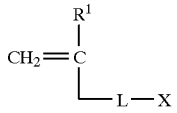

wherein $R^1$ represents a hydrogen atom, an alkyl group having from 1 to 4 carbon atoms, or a halogen atom; and L represents a single bond or a divalent linking group.

X represents an active methylene group selected from $R^2COCH_2COO$—, NC-$CH_2COO$—, $R^2COCH_2CO$—, NC-$CH_2CO$— ($R^2$ represents a substituted or unsubstituted alkyl group having from 1 to 12 carbon atoms, a substituted or unsubstituted aryl group having from 6 to 20 carbon atoms, an alkoxyl group having from 1 to 12 carbon atoms, an amino group, a substituted amino group having from 1 to 12 carbon atoms), $R^9COCH_2CON(R^6)$—($R^6$ represents a hydrogen atom or a substituted or unsubstituted alkyl group having from 1 to 6 carbon atoms, and $R^9$ represents a substituted or unsubstituted primary or secondary alkyl group having from 1 to 12 carbon atoms, an alkoxyl group having from 1 to 12 carbon atoms, an amino group or a substituted amino group having from 1 to 12 carbon atoms), and L is bonded to X in the form of alkylene, aralkylene or arylene.

Further in detail, $R^1$ represents a hydrogen atom, an alkyl group having from 1 to 4 carbon atoms (e.g., methyl, ethyl, n-propyl, n-butyl), or a halogen atom (e.g., chlorine, bromine), and more preferably represents a hydrogen atom, a methyl group or a chlorine atom.

L represents a single bond or a divalent linking group, and specifically represented by the following formula:

$$-(L^1)_m-(L^2)_n-$$

$L^1$ represents —$CON(R^3)$—(wherein $R^3$ represents a hydrogen atom, an alkyl group having from 1 to 4 carbon atoms, or a substituted alkyl group having from 1 to 6 carbon atoms),

—COO—, —NHCO—, —OCO—,

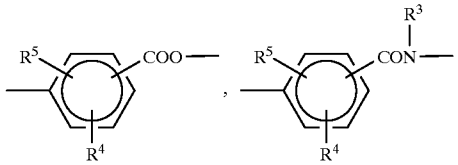

wherein $R^4$ and $R^5$ each independently represents a hydrogen atom, a hydroxyl group, a halogen atom, or a substituted or unsubstituted alkyl, alkoxyl, acyloxy or aryloxy group), $L^2$ represents a linking group which links $L^1$ with X, m represents 0 or 1, and n represents 0 or 1. When n=0, m=0. A linking group represented by $L^2$ is specifically represented by the following formula:

$$-X^1-(J^1-X^2)_p-(J^2-X^3)_q-(J^3-X^4)_r-$$

wherein $J^1$, $J^2$ and $J^3$ may be the same or different and each represents —CO—, —$SO_2$—, —$CON(R^6)$—(wherein $R^6$ represents a hydrogen atom, an alkyl group (having from 1 to 6 carbon atoms), a substituted alkyl group (having from 1 to 6 carbon atoms), —$SO_2N(R^6)$—($R^6$ has the same meaning as above), —$N(R^6)$—$R^7$—($R^6$ has the same meaning as above, and $R^7$ represents an alkylene group having from 1 to about 4 carbon atoms), —$N(R^6)$—$R^7$—$N(R^8)$—($R^6$ and $R^7$ have the same meaning as above, and $R^8$ represents a hydrogen atom, an alkyl group (having from 1 to 6 carbon atoms), a substituted alkyl group (having from 1 to 6 carbon atoms, examples of substituents include a halogen atom, an alkoxyl group (methoxy, ethoxy)), —O—, —S—, —$N(R^6)$—CO—$N(R^8)$—($R^6$ and $R^8$ have the same meaning as above), —$N(R^6)$—$SO_2$—$N(R^8)$—($R^6$ and $R^8$ have the same meaning as above), —COO—, —OCO—, —$N(R^6)CO_2$—($R^6$ has the same meaning as above), and —$N(R^6)CO$—($R^6$ has the same meaning as above).

p, q and r each represents 0 or 1.

$X^1$, $X^2$, $X^3$ and $X^4$ may be the same or different and each represents a substituted or unsubstituted alkylene group having from 1 to 10 carbon atoms, an aralkylene group having from 7 to 20 carbon atoms, or a phenylene group having from 6 to 20 carbon atoms, and the alkylene group may be straight chain or branched. Examples of the alkylene group include methylene, methylmethylene, dimethylmethylene, methoxymethylene, dimethylene, trimethylene, tetramethylene, pentamethylene, hexamethylene and decylmethylene, examples of the aralkylene group include benzylidene, and examples of the phenylene group include p-phenylene, m-phenylene, methylphenylene, chlorophenylene and methoxyphenylene.

X represents a monovalent group containing an active methylene group, and preferred examples thereof include $R^2COCH_2COO$—, $NCCH_2COO$—, $R^2COCH_2CO$—, NC-$CH_2CO$—, and $R^9COCH_2CON(R^6)$—, wherein $R^6$ has the same meaning as above, and $R^2$ represents a substituted or unsubstituted alkyl group having from 1 to 12 carbon atoms (e.g., methyl, ethyl, n-propyl, n-butyl, t-butyl, n-nonyl, 2-methoxyethyl, 4-phenoxybutyl, benzyl, 2-methanesulfonamidoethyl), a substituted or unsubstituted aryl group having from 6 to 20 carbon atoms (e.g., phenyl, p-methylphenyl, p-methoxyphenyl, o-chlorophenyl), an alkoxyl group having from 1 to 12 carbon atoms (e.g., methoxy, ethoxy, methoxyethoxy, n-butoxy), a cycloalkyloxy group (e.g., cyclohexyloxy), an aryloxy group (e.g., phenoxy, p-methylphenoxy, o-chlorophenoxy, p-cyanophenoxy), an amino group, or a substituted amino group having from 1 to 12 carbon atoms (e.g., methylamino, ethylamino, dimethylamino, butylamino).

Of the above groups, particularly preferred group is a substituted or unsubstituted primary or secondary alkyl group having from 1 to 12 carbon atoms.

$R^9$ represents a substituted or unsubstituted primary or secondary alkyl group having from 1 to 12 carbon atoms, an alkoxyl group having from 1 to 12 carbon atoms, an amino group, or a substituted amino group having from 1 to 12 carbon atoms, and specific examples are the same as those described for $R^2$. Further, particularly preferred as $R^9$ is a substituted or unsubstituted primary or secondary alkyl group having from 1 to 12 carbon atoms.

Of the above described active methylene groups represented by X, particularly effective groups in the present invention are. $R^2COCH_2COO$—, $NCCH_2COO$—, $R^2COCH_2CO$—, NC-$CH_2CO$—.

Specific examples of monomers having an active methylene group providing repeating units which constitutes the shell part of the latex of the present invention are shown below, but the present invention is not limited thereto.

M-1 2-Acetoacetoxyethyl methacrylate
M-2 2-Acetoacetoxyethyl acrylate
M-3 2-Acetoacetoxypropyl methacrylate
M-4 2-Acetoacetoxypropyl acrylate
M-5 2-Acetoacetamidoethyl methacrylate
M-6 2-Acetoacetamidoethyl acrylate
M-7 2-Cyanoacetoxyethyl methacrylate
M-8 2-Cyanoacetoxyethyl acrylate
M-9 N-(2-Cyanoacetoxyethyl)acrylamide
M-10 2-Propionylacetoxyethyl acrylate
M-11 N-(2-Propionylacetoxyethyl)methacrylamide
M-12 N-4-(Acetoacetoxybenzyl)phenylacrylamide
M-13 Ethylacryloylacetate
M-14 Acryloylmethylacetate
M-15 N-Methacryloyloxymethylacetoacetamide
M-16 Ethylmethacryloylacetoacetate
M-17 N-Allylcyanoacetamide
N-18 2-Cyanoacetylethyl acrylate
M-19 N-(2-Methacryloyloxymethyl)cyanoacetamide
M-20 p-(2-Acetoacetyl)ethylstyrene
M-21 $^4$-Acetoacetyl-1-methacryloylpiperazine
M-22 Ethyl-α-acetoacetoxy methacrylate
M-23 N-Butyl-N-acryloyloxyethylacetoacetamide
M-24 p-(2-Acetoacetoxy)ethylstyrene In the polymers which constitute the shell part of the core/shell structure of the polymer latexes of the present invention, ethylenically unsaturated monomers other than the ethylenically unsaturated monomers containing the above active methylene groups may be copolymerized.

As such monomers, acrylic esters, methacrylic esters, vinyl esters, acrylamides, methacrylamides, olefins, styrenes, vinyl ethers, and the above described monomers constituting the core part grains can be cited, and acrylic esters, methacrylic esters, vinyl esters and styrenes are particularly preferred.

In the core/shell polymer latex of the present invention, the ratio of the monomer unit having an active methylene group in the shell polymer can be changed arbitrarily in the range of 0.1 to 100 wt % according to the necessity of performance. However, if the copolymerization amount of the monomer unit having an active methylene group is increased, the aforementioned various effects are increased but when it exceeds a certain amount, in some case, these effects are saturated, therefore, the amount is, in practice, preferably 0.1 to 60 wt % and particularly preferably from 1 to 40 wt %.

The ratio of amounts between the core polymer and the shell polymer in the core/shell polymer latex of the present invention can be changed optionally, but is generally from 10/90 to 95/5, preferably from 20/80 to 95/5, and more preferably from 30/70 to 90/10, in core/shell weight ratio. This means that the concentrated effect of the active methylene monomer to the shell part is decreased if the core polymer is too little, and if the shell monomer is too little, clear core/shell structure is difficult to form.

Further, the grain size of the core/shell polymer latex is generally 1.0 μm or less, preferably 0.7 μm or less, particularly preferably 0.5 μm or less, and the lower limit is generally 0.00001 μm or less, similarly as the core polymer grains.

As is well known in the art of the technique of core/shell latex formation in emulsion polymerization, when the polarities of the core polymer and the shell polymer are near and both are compatible, it is probable that the objective core/shell structure cannot be formed sufficiently.

For the effective formation of the core/shell structure, it is desired to select polymers comprising the shell part and the core part which are hardly compatible with each other.

One very useful mode with respect to this point is to use a polymer containing a conjugated diene monomer as a core part. When a conjugated diene monomer is used in a certain amount or more, core grains become extremely low polarity, accordingly, the core/shell structure can be effectively formed with almost all the above described monomers for the shell part. The criterion for the formation of such a useful core is to contain 25% or more in weight ratio of a conjugated diene monomer. As preferred examples thereof, the following can be enumerated: a styrene-butadiene copolymer (in general, called SBR and there are solution polymer SBR and emulsion polymer SBR, and as solution polymer SBR, in addition to a random polymer, the above described block copolymer (e.g., a butadiene-styrene block copolymer, a styrene-butadiene-styrene block copolymer) can be cited), a butadiene homopolymer (e.g., cis-1,4-butadiene, trans-1,2-butadiene, or rubbers of mixtures of these homopolymers with trans-1,4-butadiene), an isoprene homopolymer (examples of the steric structure are the same as those of a butadiene polymer), a styrene-isoprene copolymer (a random copolymer, a block copolymer), an ethylene-propylenediene copolymer (as diene monomers there can be cited 1,4-hexadiene, dicyclopentadiene, ethylidenenorbornene), an acrylonitrile-butadiene copolymer, a chloroprene copolymer, an isobutylene-isoprene copolymer, a butadiene-acrylic ester copolymer (as acrylic ester, ethyl acrylate, butyl acrylate), and butadiene-acrylic ester-acrylonitrile copolymer (acrylic ester is the same as above).

In addition, a useful core/shell structure can also be formed by selecting polymers of large difference in the polarities of the core polymer and the shell polymer, for example, poly(n-dodecyl methacrylate) core/poly(methyl acrylate-co-2-acetoacetoxyethyl methacrylate) shell and poly(ethyl acrylate) core/poly(styrene-co-2-acetoacetoxyethyl acrylate) shell. However, this selection is feasible according to whether the effect of the core/shell polymer latex of the present invention is large or small, even in the combination of polymers having near polarities, the core/shell latex of the present invention shows superior film strength characteristics to non-core/shell type polymer latex.

Moreover, even when monomers having near polarities are used as the core part and the shell part, if the core part is three dimensionally crosslinked using crosslinking monomer (a monomer having two or more ethylenically unsaturated groups in the molecule), extremely effective core/shell polymer latex can be obtained.

From the above, in the present invention, useful core/shell polymer latex structure can be formed irrespective of the kind of the monomer to be used.

The glass transition point (Tg) of the core part or the shell part or both of the core part and the shell part of the core/shell latex of the present invention is preferably 50° C. or less in the point of improving effect of brittleness when added to a gelatin film, apart from the film strength characteristics, and in the point of shear stability improvement, it is preferred that Tg of the core part is lower than Tg of the shell part, more preferably Tg of the core part is less than 0° C. (the lower limit is −110° C.) and Tg of the shell part is 0° C. or more (the upper limit is 150° C.).

Tg of polymers is described in detail, for example, in J. Brandrup, E. H. Immergut, *Polymer Handbook,* 2nd Edition, III- 139 to III-192 (1975), and Tg of copolymers can be obtained according to the following equation:

$$\frac{1}{Tg} = \frac{a_1}{Tg_1} + \frac{a_2}{Tg_2} + \ldots + \frac{a_n}{Tg_n}$$

herein, $Tg_n$: Tg of a homopolymer of monomer n $a_n$: weight fraction of monomer n in a polymer $$a_1+a_2+\ldots+a_n=1$$

In the core/shell polymer latex of the present invention, the core polymer or the shell polymer or both of the core polymer and the shell polymer may be crosslinked. In this case, the molecular weight of the polymer obtained is infinite. The molecular weight of the polymer of the present invention in the case of not being crosslinked is varied according to the kind of the monomer and the conditions of the synthesis, but is generally in the range of from 5,000 to 2,000,000 and, according to the purpose, the molecular weight can be adjusted by chain transfer agents.

Preferred examples of the core/shell latex compounds of the present invention are shown below, but the present invention should not be construed as being limited thereto. The structures of the following each latex compound are described in the order of the core polymer structure, the shell polymer structure, and the ratio of the core/shell, and the copolymerization composition ratio in each polymer and the core/shell ratio are shown in weight percent ratio.

| | |
|---|---|
| P-1 to P-12 Core: styrene/butadiene copolymer (37/63) | |
| P- 1 Shell = styrene/M-1 (98/2) | core/shell = 50/50 |
| P- 2 Shell = styrene/M-1 (96/4) | core/shell = 50/50 |
| P- 3 Shell = styrene/M-1 (92/8) | core/shell = 50/50 |
| P- 4 Shell = styrene/M-1 (84/16) | core/shell = 50/50 |
| P- 5 Shell = styrene/M-1 (68/32) | core/shell = 50/50 |

-continued

| | |
|---|---|
| P- 6 Shell = styrene/M-1 (84/16) | core/shell = 67/33 |
| P- 7 Shell = styrene/M-1 (84/16) | core/shell = 85/15 |
| P- 8 Shell = n-butyl acrylate/M1 (96/4) | core/shell = 50/50 |
| P- 9 Shell = n-butyl acrylate/M1 (92/8) | core/shell = 50/50 |
| P-10 Shell = n-butyl acrylate/M-1 (84/16) | core/shell = 50/50 |
| P-11 Shell = methyl acrylate/M-7 (84/16) | core/shell = 50/50 |
| P-12 Shell = styrene/methyl acrylate/M3 (21/63/16) | core/shell = 50/50 |
| P-13 and P-14 Core: styrene/butadiene copolymer (22/78) | |
| P-13 Shell = styrene/M-2 (84/16) | core/shell = 50/50 |
| P-14 Shell = n-butyl acrylate/M8 (84/16) | core/shell = 50/50 |
| P-15 to P-20 Core: polybutadiene homopolymer (100) | |
| P-15 Shell = styrene/M1 (84/16) | core/shell = 50/50 |
| P-16 Shell = ethyl acrylate/M7/methacrylic acid (65/15/20) | core/shell = 75/25 |
| P-17 Shell = n-butyl acrylate/M1 (84/16) | core/shell = 50/50 |
| P-18 Shell = n-butyl acrylate/M2 (84/16) | core/shell = 50/50 |
| P-19 Shell = 2-ethylhexyl acrylate/M-24 (84/16) | core/shell = 50/50 |
| P-20 Shell = n-butyl acrylate/M-18 (84/16) | core/shell = 50/50 |
| P-21 to P-23 Core: polyisoprene homopolymer (100) | |
| P-21 Shell = styrene/acrylonitrile/M1 (63/21/16) | core/shell = 90/10 |
| P-22 Shell = methyl methacrylate/ethyl acrylate/M-2/sodium 2-acrylamido-2-methylpropanesulfonate (15/65/15/5) | core/shell = 75/25 |
| P-23 Shell = styrene/M-1 (84/16) | core/shell = 20/80 |
| P-24 to P-26 Core: styrene/butadiene copolymer (49/51) | |
| P-24 Shell = styrene/butyl acrylate/M-1 (26/60/15) | core/shell = 50/50 |
| P-25 Shell = M-1 (100) | core/shell = 90/10 |
| P-26 Shell = lauryl methacrylate/butyl acrylate/M7 (30/55/15) | core/shell = 40/60 |
| P-27 Core: acrylonitrile/styrene/butadiene copolymer (25/25/50) | |
| Shell = butyl acrylate/M-1 (92/8) | core/shell = 50/50 |
| P-28 Core: ethyl acrylate/butadiene copolymer (50/50) | |
| Shell = styrene/divinylbenzene/M1 (79/5/16) | core/shell = 50/50 |
| P-29 to P-33 Core: poly(n-dodecyl methacrylate) homopolymer | |
| P-29 Shell = styrene/M-1 (92/8) | core/shell = 50/50 |
| P-30 Shell = styrene/M-1 (84/16) | core/shell = 50/50 |
| P-31 Shell = ethylacrylate/M-1 (96/4) | core/shell = 50/50 |
| P-32 Shell = ethyl acrylate/M-1 (92/8) | core/shell = 50/50 |
| P-33 Shell = styrene/methyl acrylate/M-3 (21/63/16) | core/shell = 50/50 |
| P-34 Core: poly(n-butyl acrylate) homopolymer | |
| Shell = styrene/M-2 (84/16) | core/shell = 50/50 |
| P-35 and P-36 Core: poly(ethylene glycol dimethacrylate/n-butyl acrylate) copolymer (10/90) | |
| P-35 Shell = styrene/M-1 (84/16) | core/shell = 50/50 |
| P-36 Shell = methyl acrylate/M7/methacrylic acid (65/15/20) | core/shell = 75/25 |
| P-37 to P-40 Core: poly(ethylene glycol dimethacrylate/n-butyl acrylate) copolymer (20/80) | |
| P-37 Shell = styrene/M1 (84/16) | core/shell = 50/50 |
| P-38 Shell = styrene/M1 (84/16) | core/shell = 75/25 |
| P-39 Shell = methyl acrylate/M-8/sodium 2-acrylamido-2-methylpropanesulfonate (80/15/5) | core/shell = 75/25 |
| P-40 Shell = n-butyl acrylate/M-1 (84/16) | core/shell = 50/50 |
| P-41 to P-43 Core: polyvinyl acetate homopolymer (100) | |
| P-41 Shell = styrene/M-1 (84/16) | core/shell = 50/50 |
| P-42 Shell = styrene/divinylbenzene/M24 (79/5/16) | core/shell = 50/50 |
| P-43 Shell = n-dodecyl methacrylate/butyl acrylate/M-7 (30/55/15) | core/shell = 40/60 |

-continued

| | |
|---|---|
| P-44 to P-46 Core: Poly(divinylbenzene/2-ethylhexyl acrylate) copolymer (10/90) | |
| P-44 Shell = methyl acrylate/M-1 (84/16) | core/shell = 50/50 |
| P-45 Shell = methyl acrylate/styrene/M-1 (74/10/16) | core/shell = 50/50 |
| P-46 Shell = M-1 (100) | core/shell = 90/10 |
| P-47 to P-49 Core: Poly(divinylbenzene/styrene/2-ethylhexyl acrylate) copolymer (10/23/67) | |
| P-47 Shell = methyl acrylate/M-1 (84/16) | core/shell = 50/50 |
| P-48 Shell = methyl acrylate/styrene/M1 (74/10/16) | core/shell = 50/50 |
| P-49 Shell = ethyl acrylate/2-hydroxyethyl methacrylate/M-5 (65/15/20) | core/shell = 85/15 |
| P-50 Core: poly(ethylene glycol dimethacrylate/vinyl palmitate/n-butyl acrylate copolymer (20/20/60) | |
| Shell = ethylene glycol dimethacrylate/styrene/n-butyl methacrylate/M-1 (5/40/40/15) | core/shell = 50/50 |
| P-51 Core: poly(trivinyl cyclohexane/n-butyl acrylate/styrene) copolymer (10/55/35) | |
| Shell = methyl acrylate/M-1/sodium 2-acrylamido-2 methylpropanesulfonate (88/7/5) | core/shell = 70/30 |
| P-52 and P-53 Core: poly(divinylbenzene/styrene/methyl methacrylate) copolymer (10/45/45) | |
| P-52 Shell = n-butyl acrylate/M-1 (84/16) | core/shell = 50/50 |
| P-53 Shell = n-dodecyl acrylate/ethyl acrylate/M-21 (60/30/10) | core/shell = 50/50 |
| P-54 and P-55 Core: poly(p-vinyltoluene/n-dodecyl methacrylate) copolymer (70/30) | |
| P-54 Shell = methyl acrylate/n-butyl methacrylate/M-2/ acrylic acid (30/55/10/5) | core/shell = 50/50 |
| P-55 Shell = n-butyl acrylate/M-19 (84/16) | core/shell = 70/30 |

The core/shell polymer latex of the present invention can easily be obtained by adding the entire amount of the monomer for forming the shell at one time or dropwise to the aqueous dispersion obtained by emulsion polymerizing the core latex polymer and further emulsion polymerizing. Emulsion polymerization is carried out by emulsifying the monomer in water or a mixed solvent of water and an organic solvent miscible with water (e.g., methanol, ethanol, acetone) using preferably at least one emulsifier and with a radical polymerization initiator, in general, at 30° C. to about 100° C., preferably 40° C. to about 90° C. The amount of the water-miscible organic solvent is from 0 to 100%, preferably from 0 to 50%, to water in volume ratio.

Polymerization reaction is generally carried out using from 0.05 to 5 wt % of a radical polymerization initiator and, if necessary, from 0.1 to 10 wt % of an emulsifier, to the monomer to be polymerized. Examples of the radical polymerization initiator include azobis compounds, peroxides, hydroperoxides, and redox solvents, for example, potassium persulfate, ammonium persulfate, tert-butylperoctoate, benzoyl peroxide, isopropylcarbonate, 2,4-dichlorobenzyl peroxide, methyl ethyl ketone peroxide, cumene hydroperoxide, dicumyl peroxide, 2,2'-azobisisobutyrate, 2,2'-azobis(2-amidinopropane)hydrochloride and a combination of potassium persulfate with sodium hyrogensulfite.

Examples of the emulsifier include anionic, cationic, amphoteric and nonionic surfactants as well as water-soluble polymers, for example, sodium laurate, sodium dodecylsulfate, sodium 1-octoxycarbonylmethyl-1-octoxycarbonylmethanesulfonate, sodium laurylnaphthalenesulfonate, sodium laurylbenzenesulfonate, sodium laurylphosphate, cetyltrimethylammonium chloride, dodecyltrimethyleneammonium chloride, N-2-ethylhexylpyridinium chloride, polyoxyethylenenonylphenyl ether, polyoxyethylenesorbitanlauryl ester, sodium dodecyldiphenyl ether disulfonate, sodium 2-tetradecene-1-sulfonate, sodium 3-hydroxytetradecane-1-sulfonate, gelatin, PVA, and the emulsifiers and water-soluble polymers disclosed in JP-B-53-6190. Of these, anionic or nonionic surfactants and water-soluble polymers are particularly preferred.

The addition of the monomer during emulsion polymerization is preferably the dropwise addition from the point of the avoidance of generation of heat and for the formation of clear core/shell structure.

Further, after the core latex grains are formed by the emulsion polymerization in the presence of the above polymerization initiator and emulsifier, the emulsifier may further be or may not be added when the shell monomer is polymerized. The additional addition of the emulsifier is in many cases necessary from the point of the stabilization of the polymer latex produced but, in some case, grains solely comprising shell polymer other than the objective polymer are by-produced due to excessive emulsifier. Accordingly, it is preferred to effect the additional addition of the emulsifier after the formation of the core polymer such that the additional amount is suppressed within the range of from about 0.001 to 2 wt % of the core grains or not to effect the additional addition.

For the formation of the latex having a useful core/shell structure, the polymerization of the core grains at the time of the addition of the monomer for the shell formation is preferably completed as far as possible, the polymerization rate is 90% or more, preferably 95% or more, particularly preferably 100%.

The active methylene unit functions as a reactive group in the improvement of the film strength in the above polymer latex/gelatin composite film and the improvement of various characteristics in the coating and the adhesive latex. Accordingly, the amount of the active methylene unit present on the surface of the latex is an important factor functionally. The core/shell latex of the present invention is useful because it can concentrate fundamentally the active methylene unit on the surface of the latex which is a portion required to have the active methylene unit. Further, core/shell latex of the present invention is extremely useful since it enables to impart other necessary functions to the core part independently from the shell part, that is, the film forming ability exhibited by controlling Tg of the entire latex, or the physical properties (e.g., brittleness) of the film obtained or the composite film with gelatin.

The core/shell latex grains of the present invention can be obtained in the form of aqueous dispersion by the above described emulsion polymerization method, but can also be obtained in fine grain powder while maintaining the core/shell structure.

As a method of pulverization, known methods can be used such as a freeze drying method, a coagulating filtration method using a strong acid or a salt, or a coagulating filtration method by repeating freezing and thawing of a latex solution.

The addition amount of the polymer latex having the core/shell structure of the present invention is arbitrary but is preferably from 5 to 400%, more preferably from 10 to 200%, to the weight of the gelatin in a hydrophilic colloid layer.

Gelatin is preferably used as a binder for the silver halide emulsion layer and the other hydrophilic colloid layers of the present invention, but other hydrophilic colloids can also be used in combination. Examples thereof include proteins such as gelatin derivatives, graft polymers of gelatin and other high polymers, albumin and casein; cellulose derivatives such as hydroxyethyl cellulose, carboxymethyl cellulose, and cellulose sulfate; sugar derivatives such as sodium alginate, and starch derivatives; and various kinds of synthetic hydrophilic high polymers of homopolymers or copolymers such as polyvinyl alcohol, partially acetalated polyvinyl alcohol, poly-N-vinyl pyrrolidone, polyacrylic acid, polymethacrylic acid, polyacrylamide, polyvinylimidazole, and polyvinylpyrazole.

Acid-processed gelatin can be used as well as lime-processed gelatin, and hydrolyzed product and enzyme decomposed product of gelatin can also be used.

In the present invention, with respect to the coated amount of gelatin as a binder, the gelatin amount of all the hydrophilic colloid layers on the side of the support on which the silver halide emulsion layer is provided is generally 3 $g/m^2$ or less, and the gelatin amount of all the hydrophilic colloid layers on the side of the support on which the silver halide emulsion layer is provided and all the hydrophilic colloid layers on the opposite side of the support is generally 6 $g/m^2$ or less, preferably from 2.0 to 6.0 $g/m^2$.

As the support of the photographic material of the present invention, cellulose triacetate, cellulose diacetate, nitrocellulose, polystyrene, polyethylene terephthalate, the polyethylene naphthalate disclosed in JP-A-7-28188, the syndiotactic polystyrene disclosed in JP-A-3-131843, and polyethylene-laminated paper can be used.

The developing solution for development processing a photographic material in the present invention can contain various additives generally used (e.g., a developing agent, an alkali agent, a pH buffer, a preservative, a chelating agent). Any known method can be used in development processing and known developing solutions can be used in the present invention.

There are no particular limitations on the developing agent for use in the developing solution of the present invention, but it is preferred to contain dihydroxybenzenes or ascorbic acid derivatives and, further, from the point of developing ability, combinations of dihydroxybenzenes with 1-phenyl-3-pyrazolidones, dihydroxybenzenes with p-aminophenols, ascorbic acid derivatives with 1-phenyl-3-pyrazolidones, and ascorbic acid derivatives with p-aminophenols are preferred.

Dihydroxybenzene developing agents for use in the present invention include hydroquinone, chlorohydroquinone, isopropylhydroquinone, methylhydroquinone, and hydroquinone-monosulfonate, and hydroquinone is particularly preferred.

Ascorbic acid derivative developing agents for use in the present invention include ascorbic acid, erthorbic acid which is the stereoisomer thereof, and alkali metal salts thereof (sodium salt, potassium salt).

1-Phenyl-3-pyrazolidones or derivatives thereof as a developing agent for use in the present invention include 1-phenyl-3-pyrazolidone, 1-phenyl-4,4-dimethyl-3-pyrazolidone, and 1-phenyl-4-methyl-4-hydroxymethyl-3-pyrazolidone.

p-Aminophenol based developing agents for use in the present invention include N-methyl-p-aminophenol, p-aminophenol, N-(β-hydroxyethyl)-p-aminophenol, N-(4-hydroxyphenyl)glycine, and N-methyl-p-aminophenol is preferred.

Dihydroxybenzene developing agent is preferably used in an amount of from 0.05 to 0.8 mol/liter, and particularly preferably from 0.2 to 0.6 mol/liter. When dihydroxybenzene developing agent is used in combination with 1-phenyl-3-pyrazolidones or p-aminophenols, the amount used of the former is preferably from 0.05 to 0.6 mol/liter, more preferably from 0.2 to 0.5 mol/liter, and the latter is preferably from 0.06 mol/liter or less, more preferably 0.03 mol/liter or less.

Ascorbic acid derivative developing agent is used preferably in an amount of from 0.05 to 0.8 mol/liter, particularly preferably from 0.2 to 0.6 mol/liter. Further, when ascorbic acid derivative is used in combination with 1-phenyl-3-pyrazolidones or p-aminophenols, the amount of the former is preferably from 0.05 to 0.6 mol/liter, more preferably from 0.2 to 0.5 mol/liter, and the latter is preferably from 0.06 mol/liter or less, more preferably 0.03 mol/liter or less.

As the preservatives which can be used in the developing solution for use in the present invention, there are sodium sulfite, potassium sulfite, lithium sulfite, ammonium sulfite, sodium bisulfite, potassium metabisulfite, and sodium formaldehyde bisulfite. Preferred addition amount of the sulfite preservative is 0.20 mol/liter or more, particularly preferably 0.3 mol/liter or more, but too much an amount causes silver contamination, the upper limit is preferably 1.2 mol/liter, particularly preferably from 0.35 to 0.7 mol/liter.

As preservatives for a dihydroxybenzene based developing agent, a small amount of ascorbic acid derivatives may be used in combination with sulfite. As ascorbic acid derivatives, there are ascorbic acid, erthorbic acid which is the stereoisomer thereof, and alkali metal salts thereof (sodium salt, potassium salt). The use of sodium erythorbate is economically preferred. The addition amount thereof is preferably from 0.03 to 0.12, particularly preferably from 0.05 to 0.10, based on the dihydroxybenzene developing agent. When ascorbic acid derivatives are used as a preservative, it is preferred not to contain boron compounds in the developing solution.

An alkali agent which is used for setting pH, water-soluble inorganic alkali metal salt generally used (e.g., sodium hydroxide, potassium hydroxide, sodium carbonate, potassium carbonate) can be used.

Additives which can be used in the present invention, in addition to the above compounds, include a development inhibitor such as sodium bromide and potassium bromide; an organic solvent such as ethylene glycol, diethylene glycol, triethylene glycol, and dimethylformamide; a development accelerator such as alkanolamine, e.g., diethanolamine and triethanolamine, indazole or derivatives thereof; and an antifoggant or a black pepper inhibitor such as mercapto based compounds, indazole based compounds, benzotriazole based compounds and benzimidazole based compounds. Specific examples include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]butanesulfonate, 5-amino-1,3,4-thiadiazole-2-thiol, methylbenzotriazole, 5-methylbenzotriazole, and 2-mercaptobenzotriazole. The addition amount of these antifoggants is generally from 0.01 to 10 mmol, more preferably from 0.1 to 2 mmol, per liter of the developing solution.

Further, various kinds of organic and inorganic chelating agents can be used in combination in the developing solution of the present invention. Examples of the inorganic chelating agent include sodium tetrapolyphosphate and sodium hexametaphosphate.

Examples of the organic chelating agent include organic carboxylic acid, aminopolycarboxylic acid, organic phosphonic acid, aminophosphonic acid, and organic phosphonocarboxylic acid.

Examples of the organic carboxylic acid include acrylic acid, oxalic acid, malonic acid, succinic acid, glutaric acid, adipic acid, pimelic acid, aci-elaidic acid, sebacic acid, nonanedicarboxylic acid, decanedicarboxylic acid, undecanedicarboxylic acid, maleic acid, itaconic acid, malic acid, citric acid, and tartaric acid, but is not limited thereto.

Examples of the aminopolycarboxylic acid include iminodiacetic acid, nitrilotriacetic acid, nitrilotripropionic acid, ethylenediaminomonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminotetraacetic acid, and the compounds disclosed in JP-A-52-25632, JP-A-55-67747, JP-A-57-102624, and JP-B-53-40900.

Examples of the organic phosphonic acid include the hydroxyalkylidene-diphosphonic acid disclosed in U.S. Pat. Nos. 3,214,454, 3,794,591 and West German Patent Publication No. 2,227,639, and the compounds disclosed in *Research Disclosure*, Vol. 181, Item 18170 (May, 1979).

Examples of the aminophosphonic acid include aminotris (methylenephosphonic acid), ethylenediaminetetramethylenephosphonic acid, aminotrimethylenephosphonic acid, and the compounds disclosed in *Research Disclosure*, No. 18170, JP-A-57-208554, JP-A-54-61125, JP-A-55-29883 and JP-A-56-97347.

Examples of the organic phosphonocarboxylic acid include the compounds disclosed in JP-A-52-102726, JP-A-53- 42730, JP-A-54-121127, JP-A-55-4024, JP-A-55-4025, JP-A-55-126241, JP-A-55-65955, JP-A-55-65956 and *Research Disclosure*, No. 18170.

These chelating agents may be used in the form of alkali metal salts or ammonium salts. The addition amount of these chelating agents is preferably from $1\times10^{-4}$ to $1\times10^{-1}$ mol, more preferably from $1\times10^{-3}$ to $1\times10^{-2}$ mol, per liter of the developing solution.

Further, the compounds disclosed in JP-A-56-24347, JP-B-56-46585, JP-B-62-2849 and JP-A-4-362942 can be used in the developing solution as an agent for the prevention of silver contamination.

In addition, the compounds disclosed in JP-A-62-212651 can be used as an agent for preventing the occurrence of uneven development, and the compounds disclosed in JP-A-61-267759 can be used as a dissolution aid.

Further, if necessary, the developing solution may contain a toning agent, a surfactant, a defoaming agent and a hardening agent.

The developing solution for use in the present invention may contain, as a buffer, carbonate, the boric acid disclosed in JP-A-62-186259, the sugars disclosed in JP-A-60-93433 (e.g., saccharose), oximes (e.g., acetoxime), phenols (e.g., 5-sulfosalicylic acid), or tertiary phosphate (e.g., sodium salt, potassium salt). Among them, carbonate and boric acid are preferably used.

The pH of the developing solution is generally from 9.0 to 13.0, preferably from 9.5 to 12.0.

The development processing temperature and the development processing time are related reciprocally and determined in relationship with the total processing time, and the development temperature is generally from about 20° C. to about 50° C., preferably from 25° C. to 45° C., and the development time is from 5 seconds to 2 minutes, preferably from 7 seconds to 1 minute and 30 seconds.

When one square meter of a silver halide black-and-white photographic material is processed, the replenishment rate of the developing solution is generally 500 ml/m$^2$ or less, preferably 300 ml/m$^2$ or less, and more preferably from 300 to 150 ml/m$^2$.

It is preferred to concentrate processing solutions for the sake of saving costs of transportation and packaging or saving spaces, and dilute to a predetermined concentration when it is used. For concentrating the developing solution, it is effective to make the salt component contained in the developing solution into potassium salt.

The fixing solution for use in the fixing step of the present invention is an aqueous solution containing sodium thiosulfate, ammonium thiosulfate and, if necessary, tartaric acid, citric acid, gluconic acid, boric acid, iminodiacetic acid, 5-sulfosalicylic acid, glucoheptanic acid, Tiron, ethylenediaminetetraacetic acid, diethylenetriaminepentaacetic acid, nitrilotriacetic acid, and the salts of these compounds. From the viewpoint of environmental protection, boric acid is preferably not contained.

Sodium thiosulfate and ammonium thiosulfate are used as a fixing agent of the fixing solution in the present invention, and ammonium thiosulfate is preferred from the point of fixing speed, but sodium thiosulfate is preferably used from the environmental protection in recent years. The amount used of these known fixing agents can be varied arbitrarily and is generally from about 0.1 to about 2 mol/liter, particularly preferably from 0.2 to 1.5 mol/liter.

The fixing solution can contain, if desired, a hardening agent (e.g., a water-soluble aluminum compound), a preservative (e.g., sulfite, bisulfite), a pH buffer (e.g., acetic acid), a pH adjustor (e.g., ammonia, sulfuric acid), a chelating agent, a surfactant, a wetting agent, and a fixing accelerator.

Examples of the surfactant include an anionic surfactant, e.g., a sulfated product, a sulfonated product, a polyethylene surfactant, and the amphoteric surfactants disclosed in JP-A-57-6740, and known defoaming agents can also be used. Specific examples of the wetting agents include alkanolamine and alkylene glycol. Specific examples of the fixing accelerators include the thiourea derivatives disclosed in JP-B-45-35754, JP-B-58-122535 and JP-B-58-122536, an alcohol having a triple bond in the molecule, the thioether compounds disclosed in U.S. Pat. No. 4,126,459, the mesoionic compounds disclosed in JP-A-4-229860, and the compounds disclosed in JP-A-2-44355 may also be used.

Further, as a pH buffer, e.g., organic acids such as acetic acid, malic acid, succinic acid, tartaric acid, citric acid, oxalic acid, maleic acid, glycolic acid, and adipic acid, and inorganic buffers such as boric acid, phosphate and sulfite can be used. Acetic acid, tartaric acid and sulfite are preferably used.

A pH buffer is used for preventing the increase of the pH value of a fixing solution by the carryover of a developing solution, and is used generally in an amount of from 0.01 to 1.0 mol/liter, more preferably from 0.02 to 0.6 mol/liter or so.

Further, the compounds disclosed in JP-A-64-4739 can be used as a dye dissolution accelerator.

The fixing solution of the present invention contains a water-soluble aluminum salt and chromium salt as a hardening agent. Preferred compounds are a water-soluble aluminum salt, e.g., aluminum chloride, aluminum sulfate, and potassium alum. They are preferably contained in an amount of from 0.01 to 0.2 mol/liter, more preferably from 0.03 to 0.08 mol/liter.

It is preferred for the fixing solution to use gluconic acid, iminodiacetic acid, glucoheptanic acid, 5-sulfosalicylic acid, derivatives thereof, and salts thereof as a stabilizer for the hardening agent. The gluconic acid may be an anhydride having a lactone ring round it. Gluconic acid, iminodiacetic acid, alkali metal salts of these compounds, and ammonium salts of these compounds are particularly preferred. These compounds are used in one reagent type concentrated fixing solution substantially not containing a boric compound in a concentration of from 0.01 to 0.45 mol/liter and preferably from 0.03 to 0.3 mol/liter. "Substantially not containing a boric compound" means the concentration in the fixing working solution is 0.04 mol/liter or less.

These stabilizers may be used alone or in combination of two or more compounds. Further, they are preferably used in the present invention in combination with the following compounds, for example, organic acids, e.g., malic acid, tartaric acid, citric acid, succinic acid, oxalic acid, maleic acid, glycolic acid, benzoic acid, salicylic acid, Tiron, ascorbic acid, glutaric acid, and adipic acid; amino acids, e.g., aspartic acid, glycine, and cysteine; aminopolycarboxylic acids, e.g., ethylenediaminetetraacetic acid, diethylenetriaminepentaacetic acid, 1,3-propanediaminetetraacetic acid, and nitrilotriacetic acid; and saccharides.

The pH of the e fixing solution is generally 3.8 or more, preferably from 4.0 to 6.0.

The temperature of the fixing solution is from about 20° C. to about 50° C., preferably from 25° C. to 45° C., and the fixing time is from 5 seconds to 1 minute, preferably from 7 seconds to 50 seconds.

The replenishment rate of the fixing solution is generally 600 ml/$m^2$ or less, particularly preferably 300 ml/$m^2$ or less, of the material processed.

A photographic material is subjected to washing or stabilizing processing after being development processed and fixing processed.

Washing or stabilizing processing is generally carried out with a washing water of 20 liters or less per $m^2$ of the silver halide photographic material, and can be carried out with a replenishing rate of 3 liters or less per $m^2$ of the photographic material (including zero, i.e., washing in a reservoir). That is, not only water saving processing can be carried out but also piping for installation of an automatic processor is not required.

As a means of reducing the replenishment rate of the washing water, a multistage countercurrent system (for example, two stages or three stages) has been known. If this multistage countercurrent system is applied to the present invention, the photographic material after fixation is gradually advanced to, contacted with and processed by processing solutions not contaminated with a fixing solution, accordingly, further effective water washing can be carried out.

When washing is carried out with a reduced amount of water, it is preferred to use a washing tank equipped with a squeegee roller or a crossover roller disclosed in JP-A-63-18350 and JP-A-62-287252. The addition of various kinds of oxidizing agents and the provision of filters for filtration may be combined to reduce environmental pollution which becomes a problem when washing is carried out with a small amount of water.

Further, all or a part of the overflow generated from the washing tank or the stabilizing tank by the replenishment of the water applied with an antimold means by the method according to the present invention to the washing tank or the stabilizing tank in proportion to the progress of the processing can be utilized in the preceding processing step, i.e., a processing solution having a fixing ability as disclosed in JP-A-60-235133.

Moreover, a water-soluble surfactant or a defoaming agent may be included in washing water to prevent generation of irregular foaming which is liable to occur when washing is conducted with a small amount of water and/or to prevent components of the processing agents adhered to a squeegee roller from transferring to the processed film.

In addition, the dye adsorbents disclosed in JP-A-63-163456 may be included in a washing tank to inhibit contamination by dyes dissolved from photographic materials.

Also, when a photographic material is subjected to stabilizing processing after the washing processing, bath containing compounds disclosed in JP-A-2-201357, JP-A-2-132435, JP-A-1-102553 and JP-A-46-44446 may be used as a final bath.

This stabilizing bath may contain, if desired, ammonium compounds, metal compounds such as Bi and Al, whitening agents, various kinds of chelating agents, film pH adjustors, hardening agents, sterilizers, antimold agents, alkanolamines, and surfactants. Tap water, deionized water, and water sterilized by a halogen, ultraviolet sterilizing lamp or various oxidizing agents (e.g., ozone, hydrogen peroxide, chlorate) are preferably used as washing water in a washing step or a stabilizing step. Further, the washing water containing the compounds disclosed in JP-A-4-39652 and JP-A-5-241309 can also be used.

The temperature and the time of the washing or stabilizing processing are preferably from 0 to 50° C. and from 5 seconds to 2 minutes, respectively.

The processing solutions for use in the present invention are preferably preserved in the packaging materials of low oxygen permeation as disclosed in JP-A-61-73147.

The processing solutions for use in the present invention may be made into powders or solids. The solids (powders, granulated powders, pellets, lumps, paste) and tablets for the processing solution in the present invention may comprise a plurality of layers such that components which contact and react with each other are not contained in adjacent layers, or one and/or a mixture of a plurality of components which are not react with each other may be coated and packaged with a water-soluble coating material and/or a water-soluble film.

The solids and tablets for the processing solution in the present invention can be produced by any known method. For example, the packaging methods disclosed in JP-A-61-259921, JP-A-4-16841 and JP-A-4-78848 can be applied to the present invention. Also, the methods of producing solids and tablets disclosed in JP-A-4-85533, JP-A-4-85534, JP-A-4-85535, JP-A-5-134362, JP-A-5-197090, JP-A-5-204098, JP-A-5-224361, JP-A-6-138604 and JP-A-6-138605 can be applied to the present invention.

There are various methods of dissolving and replenishing processing agents, for example, a method of dissolving a certain amount of processing agents by a dissolving device having a stirring function and then replenishing, a method of dissolving processing agents using a dissolving device having a dissolving part and a part which stocks the finished solution and replenishing from the stock part, a method of charging processing agents in the circulating system of an automatic processor according to process and dissolving and replenishing, or a method of dissolving and replenishing processing agents in an automatic processor having a dissolving tank, and any other known method can be used in the present invention.

In the case when the replenishment rate is reduced, it is preferred to prevent evaporation and air oxidation of the solution by minimizing the area of contact of the solution with the air in the processing tank. A roller transporting type automatic processor is disclosed in U.S. Pat. Nos. 3,025,779 and 3,545,971 and referred to as merely a roller transporting type processor in the specification of the present invention. A roller transporting type processor comprises four steps of development, fixation, washing and drying and, although the method of the present invention does not exclude other steps (e.g., stopping step), it is most preferred to follow this four step system. A stabilization step may be carried out in place of a washing step.

There are no particular limitations on various additives use in the photographic material of the present invention and, for example, those described in the following places can be preferably used.

| Item | Places |
|---|---|
| 1) Silver halide emulsion and the preparation method thereof | line 12, right lower column, page 20 to line 14, left lower column, page 21 of JP-A-2-97937; line 19, right upper column, page 7 to line 12, left lower column, page 8 of JP-A-2-12236; JP-A-4-330430; and JP-A-5-11389 |
| 2) Spectral sensitizing dye | line 8, left upper column, page 7 to line 8, right lower column, page 8 of JP-A-2-55349; line 8, right lower column, page 7 to line 5, right lower column, page 13 of JP-A-2-39042; line 13, left lower column, page 8 to line 4, right lower column, page 8 of JP-A-2-12236; line 3, right lower column, page 16 to line 20, left lower column, page 17 of JP-A-2-103536; JP-A-1-112235; JP-A-2-124560; JP-A-3-7928; JP-A-5-11389 and JP-A-4-330434 |
| 3) Nucleation accelerating agent | formulae (II-m) to (II-p) and Compounds II-1 to II-22 in line 13, right upper column, page 9 to line 10, left upper column, page 16 of JP-A-2-103536; and the compounds disclosed in JP-A-1-179939 |
| 4) Surfactant | line 7, right upper column, page 9 to line 7, right lower column, page 9 of JP-A-2-12236 |
| 5) Compound having acid radical | line 6, right lower column, page 18 to line 1, left upper column, page 19 of JP-A-2-103536; and line 13, right lower column, page 8 to line 8, left upper column, page 11 of JP-A-2-55349 |
| 6) Antifoggant | line 19; right lower column, page 17 to line 4, right upper column, page 18 of JP-A-2-103536; lines 1 to 5, right lower column, page 18 of JP-A-2-103536; and the thiosulfinic acid compounds in JP-A-1-237538 |
| 7) Polyhydroxybenzenes | line 9, left upper column, page 11 to line 17, right lower column, page 11 of JP-A-2-55349 |
| 8) Sliding agent and plasticizer | line 6, right upper column, page 19 to line 15, right upper column, page 19 of JP-A-2-103536 |
| 9) Hardening agent | lines 5 to 17, right upper column, page 18 of JP-A-2-103536 |
| 10) Dye | lines 1 to 18, right lower column, page 17 of JP-A-2-103536; line 1, right upper column, page 4 to line 5, right upper column, page 6 of JP-A-2-39042; and the solid dyes described in JP-A-2-294638 and JP-A-5-11382 |
| 11) Tetrazolium compound | line 8, left lower column, page 4 to line 6, left lower column, page 6 of JP-A-2-39143; line 19, right upper column, page 3 to line 20, left upper column, page 5 of JP-A-3-123346 |
| 12) Black pepper inhibitor | The compounds in U.S. Pat. No. 4,956,257 and JP-A-1-118832 |
| 13) Redox compound | The compounds represented by formula (I) (particularly Compounds 1 to 50) in JP-A-2-301743; Formulae (R-1), (R-2) and (R-3), Compounds 1 to 75 on pages 3 to 20 in JP-A-3-174143; and the compounds in JP-A-5-257239 and JP-A-4-278939 |
| 14) Monomethine dye | The compounds represented by formula (II) (particularly Compounds II-1 to II-26) in JP-A-2-287532 |
| 15) Colloidal silica | The compounds in column 0005 of JP-A-4-214551 |
| 16) Matting agent | line 15, left upper column, page 19 to line 6, right upper column, page 19 of JP-A-2-103536; line 8, left lower column, page 2 to line 4, right upper column, page 3 of JP-A-3-109542; line 7, right upper column, page 3 to line 4, right lower column, page 5 of JP-A-4-127142; and columns 0005 to 0026 of JP-A-6-118542 |
| 17) Antistatic agent | The conductive compounds and fluorine surfactants in U.S. Pat. No. 4,999,276 |

EXAMPLE

The present invention will be described in detail with reference to the examples but the present invention is not limited thereto.

Example 1

Preparation of Silver Halide Photographic Material

Preparation of Emulsion

Emulsion A was prepared in the following method.

Emulsion A

An aqueous solution of silver nitrate and an aqueous solution of silver halide containing potassium bromide, sodium chloride, $K_3IrCl_6$ in an amount of $3.5\times10^{-7}$ mol per mol of silver and $K_2Rh(H_2O)Cl_5$ in an amount of $2.0\times10^{-7}$ mol per mol of silver were added to an aqueous solution of gelatin containing sodium chloride and 1,3-dimethyl-2-imidazolidinethione with stirring by a double jet method to obtain silver chlorobromide grains having an average grain size of 0.25 $\mu$m and silver chloride content of 70 mol %.

The emulsion was then washed with water by an ordinary flocculation method. Gelatin in an amount of 40 g per mol of silver, sodium benzenethiosulfonate in an amount of 7 mg per mol of silver and benzenesulfinic acid in an amount of 2 mg per mol of silver were added to the emulsion so that the pH value and pAg value thereof were adjusted to 6.0 and 7.5, respectively. To the emulsion were then added sodium thiosulfate in an amount of 2 mg and chloroauric acid in an amount of 4 mg, each per mol of silver, and the emulsion was optimally sensitized at 60° C. 4-Hydroxy-6-methyl-1,3,3a,7-tetraazaindene in an amount of 150 mg as a stabilizer and Compound (a) in an amount of 100 mg as a preservative were added to the emulsion. Cubic silver chlorobromide grains having an average grain size of 0.25 $\mu$m and a silver chloride content of 70 mol % were obtained. (Variation coefficient: 10%)

Compound (a)

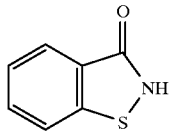

Proxel (manufactured by I.C.I. Co., England)

Preparation of Coated Sample

On a polyethylene terephthalate film support having a moisture preventing undercoat layer containing vinylidene chloride, UL layer, EM layer, PC layer and OC layer were coated in this order from the support side to prepare a sample.

The preparation method and the coating amount of each layer are shown below.

UL Layer

The dispersion of the polymer latex shown in Table 1 was added to an aqueous solution of gelatin in an amount of 30 wt % based on gelatin. The resulting dispersion was coated on the support in an amount such that the coated amount of gelatin reached 0.5 g/m$^2$.

EM Layer

To the above Emulsion A were added the following Compounds (S-1) in an amount of $5\times10^{-4}$ mol and (S-2) in an amount of $5\times10^{-4}$ mol, each per mol of silver as a sensitizing dye. To the emulsion were further added a mercapto compound of the following formula (b) in an amount of $3\times10^{-4}$ mol, a mercapto compound of the following formula (c) in an amount of $4\times10^{-4}$ mol, a triazine compound of the following formula (d) in an amount of $4\times10^{-4}$ mol, 5-chloro-8-hydroxyquinoline in an amount of $2\times10^{-3}$ mol, the following Compound (e) in an amount of $5\times10^{-4}$ mol, and the following Compound (A) in an amount of $4\times10^{-4}$ mol, each per mol of silver. Further, hydroquinone and sodium N-oleyl-N-methyltaurine was added to the emulsion such that the coated amount reached 100 mg/m$^2$ and 30 mg/m$^2$, respectively. Still further, to the emulsion were added the hydrazine derivative shown in Table 1 in an amount of $0.8\times10^{-5}$ mol/m$^2$, a polymer latex of the following formula (f) in an amount of 200 mg/m$^2$, the polymer latex shown in Table 1 in an amount of 200 mg/m$^2$, a colloidal silica (Snowtex C, manufactured by Nissan Chemicals Co., Ltd.) having an average particle size of 0.02 $\mu$m in an amount of 200 mg/m$^2$, and 1,2-bis (vinylsulfonylacetamido)ethane as a hardening agent in an amount of 200 mg/m$^2$. The pH value of the emulsion was adjusted to 5.65 with acetic acid. The thus obtained coating solution was coated on the support in an amount such that the coated amounts of silver and gelatin reached 3.5 g/m$^2$ and 1.3 g/m$^2$, respectively.

(S-1)

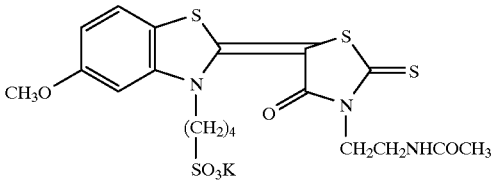

-continued (S-2)

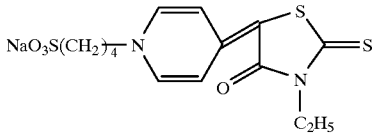

(b)

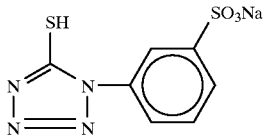

(c)

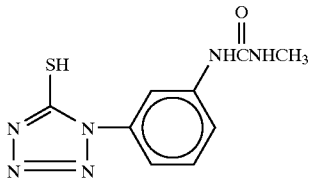

(d)

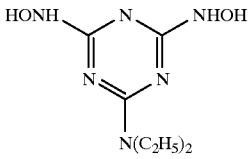

(A)

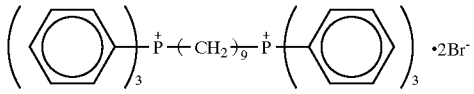

(e)

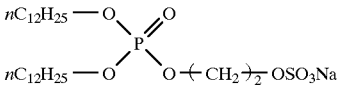

(f)

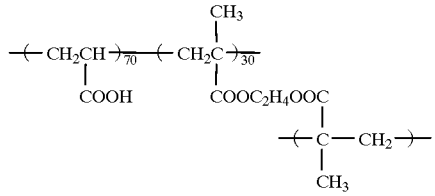

PC Layer

To an aqueous gelatin solution were added the polymer latex shown in Table 1 in an amount of 50 wt % based on gelatin, the following Surfactant (g) so as to provide the coated amount of 5 mg/m$^2$, and 1,5-dihydroxy-2-benzaldoxime so as to provide the coated amount of 10 mg/m$^2$, and the thus obtained coating solution was coated on the above support in an amount such that the coated amount of gelatin reached 0.5 g/m$^2$.

OC Layer

On the support were coated 0.5 g/m$^2$ of gelatin, 40 mg/m$^2$ of an amorphous $SiO_2$ matting agent having an average grain size of about 3.5 $\mu$m, 0.1 g/m$^2$ of a colloidal silica (Snowtex C, manufactured by Nissan Chemicals Co., Ltd.), 100 mg/m$^2$ of polyacrylamide, 20 mg/m$^2$ of Sliding Agent (h) and 5 mg/m$^2$ of a fluorine surfactant of the following formula (i) and 100 mg/m $^2$ of sodium dodecylbenzenesulfonate as coating aids.

(g)

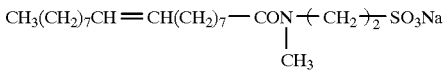

(h)

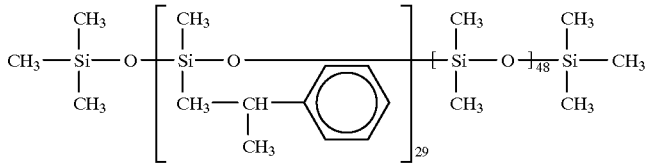

(i)

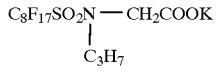

Subsequently, a conductive layer and a backing layer shown below were simultaneously coated on the opposite side of the support.

| Conductive Layer | |
|---|---|
| $SnO_2$/Sb (9/1 by weight ratio, average grain size: 0.25 μm) | 250 mg/m$^2$ |
| Gelatin ($Ca^{++}$ content: 3,000 ppm) | 100 mg/m$^2$ |
| Compound (a) | 7 mg/m$^2$ |
| Sodium Dodecylbenzenesulfonate | 20 mg/m$^2$ |
| Dihexyl-α-sulfosuccinate Sodium Salt | 20 mg/m$^2$ |
| Sodium Polystyrenesulfonate | 20 mg/m$^2$ |
| **Backing Layer** | |
| Gelatin ($Ca^{++}$ content: 30 ppm) | 2.6 g/m$^2$ |
| Dye (mixture of Dye (a), Dye (b) and Dye (c)) | |
| Dye (a) | 70 mg/m$^2$ |
| Dye (b) | 70 mg/m$^2$ |
| Dye (c) | 90 mg/m$^2$ |
| Sodium Dodecylbenzenesulfonate | 80 mg/m$^2$ |
| Dibenzyl-α-sulfosuccinate Sodium Salt | 20 mg/m$^2$ |
| 1,2-Bis(vinylsulfonylacetamido)ethane | 110 mg/m$^2$ |
| Sodium Acetate | 40 mg/m$^2$ |
| Lithium Perfluorooctanesulfonate | 5 mg/m$^2$ |
| Polymethyl Methacrylate Fine Grains (average grain size: 4.5 μm) | 30 mg/m$^2$ |

Dye(a)

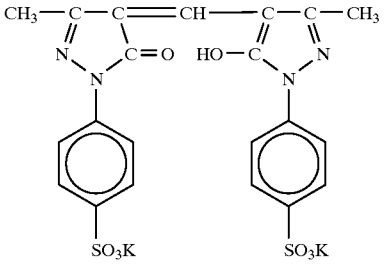

-continued

Dye (b)

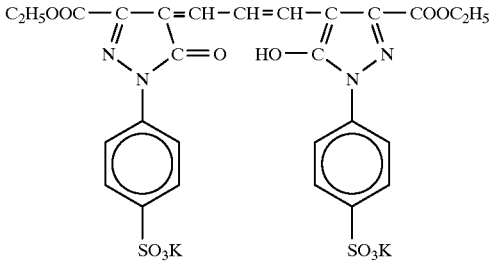

Dye (c)

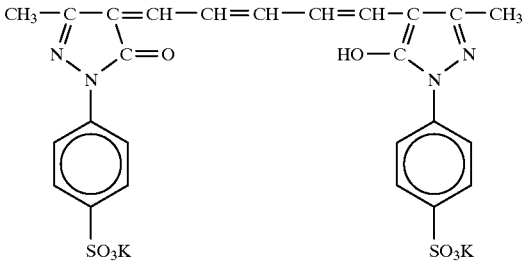

The obtained sample was preserved under the atmosphere of 25° C., 55% RH for one week and was evaluated for (1) photographic performances and (2) wet film strength. The results obtained are shown in Table 1 below.

It is apparently understood from Table 1 that the samples of the present invention show superhigh contrast and excellent in wet film strength.

TABLE 1

| Sample No. | Hydrazine Derivative | Polymer Latex (UL layer EM layer, PC layer) | Gamma Value | Wet Film Strength (g) |
|---|---|---|---|---|
| 1 (Invention) | I-33 | P-4 | 26 | 210 |
| 2 (Invention) | " | P-12 | 25 | 205 |
| 3 (Invention) | " | P-37 | 25 | 200 |
| 4 (Invention) | " | P-44 | 24 | 200 |

TABLE 1-continued

| | | | | |
|---|---|---|---|---|
| 5 | " | Comparative Example-1 | 15 | 100 |
| 6 | " | Comparative Example-2 | 17 | 145 |
| 7 | " | Comparative Example-3 | 16 | 160 |
| 8 | " | Comparative Example-4 | 16 | 165 |
| 9 (Invention) | I-55 | P-4 | 25 | 210 |
| 10 (Invention) | " | P-12 | 25 | 205 |
| 11 (Invention) | " | P-37 | 24 | 200 |
| 12 (Invention) | " | P-44 | 25 | 200 |
| 13 | " | Comparative Example-1 | 16 | 100 |
| 14 | " | Comparative Example-2 | 15 | 145 |
| 15 | " | Comparative Example-3 | 17 | 160 |
| 16 | " | Comparative Example-4 | 15 | 165 |
| 17 (Invention) | I-56 | P-4 | 26 | 210 |
| 18 (Invention) | " | P-12 | 26 | 205 |
| 19 (Invention) | " | P-37 | 25 | 200 |
| 20 (Invention) | " | P-44 | 25 | 200 |
| 21 | " | Comparative Example-1 | 15 | 100 |
| 22 | " | Comparative Example-2 | 17 | 145 |
| 23 | " | Comparative Example-3 | 16 | 160 |
| 24 | " | Comparative Example-4 | 15 | 165 |

Comparative Example (polymer latex having a uniform structure)

Comparative Example-1:

Ethyl acrylate/acrylic acid copolymer (99/1 wt %)

Comparative Example-2:

Methyl acrylate/sodium 2-acrylamido-2-mehtylpropanesulfonate/2-acetoacetoxyethyl methacrylate copolymer (88/5/7 wt %)

Comparative Example-3:

n-Butyl acrylate/acrylic acid/2acetoacetoxyethyl methacrylate copolymer (80/4/16 wt %)

Comparative Example-4:

Styrene/acrylic acid/2-acetoacetoxyethyl methacrylate copolymer (80/4/16 wt %)

(1) Evaluation of Photographic Performance

The samples obtained were exposed with a xenon flash light of $10^{-5}$ sec. through an interference filter which had a peak at 480 nm and a step wedge, and after being development processed at 35° C. for 30 sec. using an automatic processor FG-680AG produced by Fuji Photo Film Co., Ltd. with Developing Solution A having the composition shown below, underwent fixing, washing and drying processes.

The gradient of the straight line joining the points of fog+density 0.3 and fog+density 3.0 of the characteristic curve was taken as the index (gamma value) showing the contrast of images. That is, gamma=(3.0–0.3)/[log(exposure amount giving a density of 3.0)–log(exposure amount giving a density of 0.3)]. The larger the gamma value, the higher is the contrast. As photographic materials for graphic arts, gamma value is preferably 10 or more, more preferably 15 or more.

(2) Wet Film Strength

After the samples were immersed in distilled water of 25° C. for 5 minutes, a sapphire needle of a radius of 0.3 mm was put on the film surface of the sample tightly and moved at a speed of 10 mm/sec. with varying the load of the needle continuously and the load (grams) when the film was broken was measured.

| Developing Solution A | |
|---|---|
| Potassium Hydroxide | 35.0 g |
| Diethylenetriaminepentaacetic Acid | 2.0 g |
| Potassium Carbonate | 12.0 g |
| Sodium Metabisulfite | 40.0 g |
| Potassium Bromide | 3.0 g |
| Hydroquinone | 25.0 g |
| 5-Methylbenzotriazole | 0.08 g |
| 4-Hydroxymethyl-4-methyl-1-phenyl-3-pyrazolidone | 0.45 g |
| 2,3,5,6,7,8-Hexahydro-2-thioxo-4-(1H)-quinazolinone | 0.04 g |
| Sodium 2-Mercaptobenzimidazole-5-sulfonate | 0.15 g |
| Sodium Erythorbate | 3.0 g |
| Water to make | 1 liter |
| pH was adjusted to 10.5 with potassium hydroxide | |

The replenishment rate was 300 ml/m$^2$.

The composition of the fixing solution which was used is shown below.

| Formulation of Fixing Solution | |
|---|---|
| Ammonium Thiosulfate | 359.1 g |
| Disodium Ethylenediaminetetraacetate Dihydrate | 0.09 g |
| Sodium Thiosulfate Pentahydrate | 32.8 g |
| Sodium Sulfite | 64.8 g |
| NaOH | 37.2 g |
| Glacial Acetic Acid | 87.3 g |
| Tartaric Acid | 8.76 g |
| Sodium Gluconate | 6.6 g |
| Aluminum Sulfate | 25.3 g |
| Water to make | 3 liters |
| pH (adjusted with sulfuric acid or sodium hydroxide) | 4.85 |
| The replenishment rate was 250 ml/m$^2$. | |

Example 2

On one side of the same support as used in Example 1, the conductive layer in Example 1 and the following backing layer were coated simultaneously.

| Backing Layer | |
|---|---|
| Gelatin ($Ca^{++}$ content: 3,000 ppm) | 2.0 g/m$^2$ |
| Compound (1) | 3 mg/m$^2$ |
| Compound (2) | 40 mg/m$^2$ |
| Compound (3) | 40 mg/m$^2$ |
| Compound (4) | 155 mg/m$^2$ |
| Compound (5) | 150 mg/m$^2$ |
| Sodium Dodecylbenzenesulfonate | 7 mg/m$^2$ |
| Dihexyl-α-sulfosuccinate Sodium Salt | 30 mg/m$^2$ |
| 1,2-Bis(vinylsulfonylacetamido)ethane | 140 mg/m$^2$ |
| Sodium Sulfate | 180 mg/m$^2$ |
| Compound (6) | 5 mg/m$^2$ |
| Polymethyl Methacrylate Fine Grains (average grain size: 4.7 μm) | 10 mg/m$^2$ |

-continued

Compound (1)

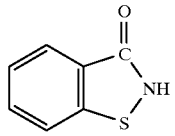

Compound (2)

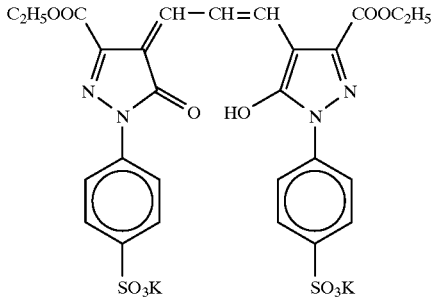

Compound (3)

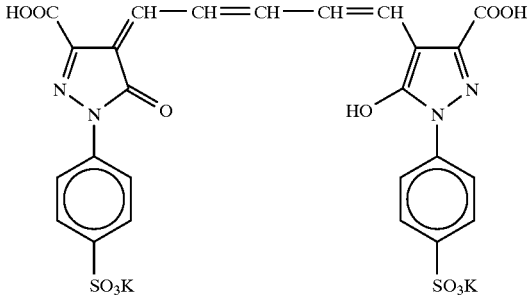

Compound (4)

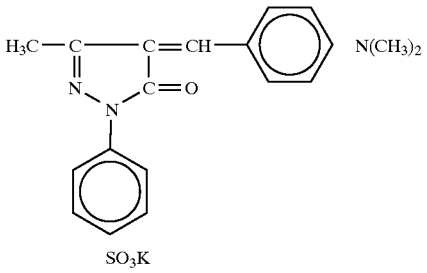

-continued

Compound (5)

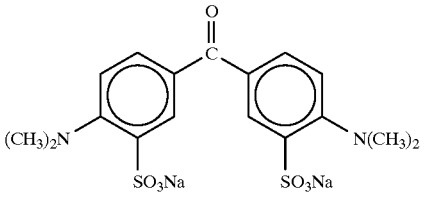

Compound (6)

$C_8F_{17}SO_3Li$

Then, a first emulsion layer, a second emulsion layer, a lower protective layer and an upper protective layer were simultaneously coated on the opposite side of the support.

First Emulsion Layer

An aqueous solution of silver nitrate and an aqueous solution of sodium chloride containing $(NH_4)_2Rh(H_2O)Cl_5$ in an amount of $2\times10^{-5}$ mol per mol of silver were added at the same time over a period of 7 minutes to an aqueous solution of gelatin maintained at 40° C. which contained 4-hydroxy-6-methyl-1,3,3a,7-tetraazaindene in an amount of $5\times10^{-3}$ mol per mol of silver, and the grains of the core part having a grain size of 0.12 $\mu$m were prepared by controlling the potential during this time at 95 mV. Subsequently, an aqueous solution of silver nitrate and an aqueous solution of sodium chloride containing $(NH_4)_2Rh(H_2O)Cl_5$ in an amount of $1.2\times10^{-4}$ mol per mol of silver were added thereto at the same time over a period of 14 minutes, and silver chloride cubic grains having an average grain size of 0.15 $\mu$m were prepared by controlling the potential during this time at 95 mV.

To this emulsion were added $2.2\times10^{-5}$ mol/m$^2$ of a mixed solution of Hydrazine Derivatives I-13 and I-1 in a mol ratio of 1/1, 30 mg/m$^2$ of 4-hydroxy-6-methyl-1,3,3a,7-tetraazaindene, 40 mg/m$^2$ of the following Compound (7) and 10 mg/m$^2$ of the following Compound (8), polymer latex as indicated in Table 2, and 1,1-bis(vinylsulfonyl) methane as a hardening agent in an amount of 55 mg per gram of gelatin coated on the side of the support on which emulsion layers were provided. The resulting emulsion was coated on the support in an amount such that the coated amount of silver was 1.6 g/m$^2$ and the coated amount of gelatin was as shown in Table 2.

Compound (7)

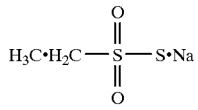

-continued

Compound (8)

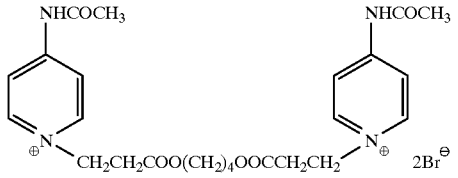

Second Emulsion Layer

An aqueous solution of silver nitrate and an aqueous solution of sodium chloride containing $(NH_4)_2Rh(H_2O)Cl_5$ in an amount of $4\times10^{-5}$ mol per mol of silver were added at the same time over a period of 3 minutes and 30 seconds to an aqueous solution of gelatin maintained at 40° C. which contained 5,6-cyclopentane-4-hydroxy-1,3,3a,7-tetraazaindene in an amount of $5\times10^{-3}$ mol per mol of silver, and the grains of the core part having a grain size of 0.08 μm were prepared by controlling the potential during this time at 95 mV. Subsequently, an aqueous solution of silver nitrate and an aqueous solution of sodium chloride containing $(NH_4)_2Rh(H_2O)Cl_5$ in an amount of $1.2\times10^{-4}$ mol per mol of silver were added thereto at the same time over a period of 7 minutes, and silver chloride cubic grains having an average grain size of 0.10 μm were prepared by controlling the potential during this time at 95 mV.

An emulsion layer was coated on the support as a second emulsion layer in the same manner as the first emulsion layer except for using this emulsion in such an amount that the coated amount of silver was 1.0 g/m$^2$ and the amount of gelatin was as shown in Table 2.

| | |
|---|---|
| Lower Protective Layer | |
| Gelatin | 0.60 g/m$^2$ |
| Polymer Latex Compound P-4 | 0.50 g/m$^2$ |
| 1-Hydroxy 2-benzaldoxine | 15 mg/m$^2$ |
| Compound (9) | 80 mg/m$^2$ |
| Compound (10) | 10 mg/m$^2$ |
| Upper Protective Layer | |
| Gelatin | 0.40 g/m$^2$ |
| Amorphous Matting Agent ($SiO_2$, average size: 4.4 μm) | 30 mg/m$^2$ |
| Liquid Paraffin (gelatin dispersion) | 50 mg/m$^2$ |
| N-Perfluorooctanesulfonyl-N propylglycine Potassium Salt | 5 mg/m$^2$ |
| Sodium Dodecylbenzenesulfonate | 10 mg/m$^2$ |
| Solid Dispersion Dye A* | 80 mg/m$^2$ |
| Solid Dispersion Dye B* | 40 mg/m$^2$ |

Preparation of Fine Grain Dispersions of Solid Dispersion Dyes A and B

The preparation method was according to the method in JP-A-63-197943.

That is, water (434 ml) and a 6.7% solution of Triton X-200R surfactant, TX-200R (53 g), commercially available from Rohm & Haas were put in a bottle with a screw cap having a capacity of 1.5 liters, and 20 g of the dye and 800 ml of zirconium oxide beads ($ZrO_2$) (diameter: 2 mm) were added thereto and the cap was tightly screwed and put in a mill and the content was pulverized for four days.

The content was added to 160 g of a 12.5% aqueous gelatin solution and put in a roll mill for 10 minutes to be defoamed. The mixture obtained was filtrated to remove $ZrO_2$ beads. The average grain size of the dispersion was about 0.3 μm but coarse grains were contained as it was, the dispersion was classified by a centrifugal separation method so that the largest grain size was 1 μm or less.

Compound (9)

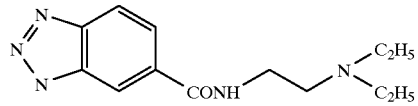

Compound (10)

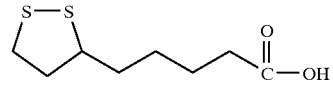

Solid Dispersion Dye A

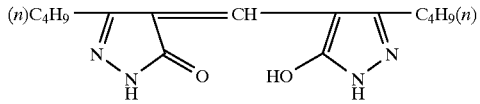

Solid Dispersion Dye B

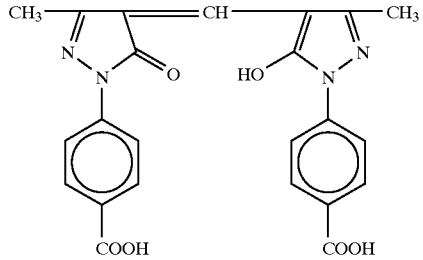

The obtained samples were preserved in the same manner as in Example 1, and photographic performance and wet film strength were evaluated as in Example 1. However, the evaluation of photographic performance was conducted as follows.

Evaluation of Photographic Performance

Samples were subjected to exposure through an optical wedge using a daylight printer FPA-800FX (using a Fresnel lens) produced by Fuji Photo Film Co., Ltd. Samples were development processed at 38° C. for 20 sec. using an automatic processor FG-680AG manufactured by Fuji Photo Film Co., Ltd. with a Developing Solution B having the composition shown below and the same fixing solution as used in Example 1.

The results obtained are shown in Table 2. As can be seen from Table 2, the samples of the present invention provide superhigh contrast images and strong in wet film strength irrespective of the reduction of gelatin amount and the increase of the polymer latex/gelatin ratio.

TABLE 2

| Sample No. | First Emulsion Layer Gelatin ($g/m^2$) | First Emulsion Layer Polymer Latex ($g/m^2$) | Second Emulsion Layer Gelatin ($g/m^2$) | Second Emulsion Layer Polymer Latex ($g/m^2$) | Amount of Gelatin on Emulsion Layer Side ($g/m^2$) | Gamma Value | Wet Film Strength (g) |
|---|---|---|---|---|---|---|---|
| 25 (Invention) | 1.54 | P-4 0.77 | 0.96 | P-4 0.48 | 3.5 | 13 | 280 |
| 26 (Invention) | 1.23 | P-4 0.62 | 0.77 | P-4 0.39 | 3.0 | 15 | 250 |
| 27 (Invention) | 0.92 | P-4 0.46 | 0.58 | P-4 0.29 | 2.5 | 16 | 220 |
| 28 (Invention) | 0.61 | P-4 0.31 | 0.39 | P-4 0.20 | 2.0 | 16 | 200 |
| 29 (Invention) | 0.61 | P-4 0.49 | 0.39 | P-4 0.31 | 2.0 | 16 | 200 |
| 30 (Invention) | 0.61 | P-4 0.61 | 0.39 | P-4 0.39 | 2.0 | 16 | 200 |
| 31 | 1.23 | Comp. Ex.-3* 0.62 | 0.77 | Comp. Ex.-3 0.39 | 3.0 | 10 | 150 |
| 32 | 0.61 | Comp. Ex.-3* 0.31 | 0.39 | Comp. Ex.-3 0.20 | 2.0 | 10 | 140 |
| 33 | 0.61 | Comp. Ex.-3* 0.49 | 0.39 | Comp. Ex.-3 0.31 | 2.0 | 9 | 110 |
| 34 | 0.61 | Comp. Ex.-3* 0.61 | 0.39 | Comp. Ex.-3 0.39 | 2.0 | 8 | 95 |

*Comparative Example-3: n-Butyl acrylate/acrylic acid/2-acetoacetoxyethyl methacrylate copolymer (80/4/16 wt %)

| Developing Solution B | |
|---|---|
| Potassium Hydroxide | 90.0 g |
| Sodium Hydroxide | 8.0 g |
| Disodium Ethylenediaminetetraacetate | 1.0 g |
| Boric Acid | 24.0 g |
| Sodium Metabisulfite | 65.0 g |
| Potassium Bromide | 10.0 g |
| Hydroquinone | 55.0 g |
| 5-Methylbenzotriazole | 0.40 g |
| N-Methyl-p-aminophenol | 0.50 g |
| Sodium 2-Mercaptobenzimidazole-5-sulfonate | 0.30 g |
| Sodium 3-(5-mercaptotetrazole)-benzenesulfonate | 0.20 g |
| N-n-Butyldiethanolamine | 14.0 g |
| N,N-Dimethylamino-6-hexanol | 0.20 g |
| Sodium Toluenesulfonate | 8.0 g |
| 5-Sulfosalicylic Acid | 23.0 g |
| Water to make | 1 liter |
| pH was adjusted with potassium hydroxide | 11.9 |
| Replenishment rate was 240 $ml/m^2$. | |

Example 3

First and second undercoat layers having the compositions shown below were coated on both sides of biaxially stretched polyethylene terephthalate support (thickness: 100 $\mu$m).

| First Undercoat Layer | |
|---|---|
| Core/Shell Type Vinylidene Chloride Copolymer (1) | 15 g |
| 2,4-Dichloro-6-hydroxy-s-triazine | 0.25 g |
| Polystyrene Fine Particles (average particle size: 3 $\mu$m) | 0.05 g |
| Compound 1 | 0.20 g |
| Colloidal Silica (Snowtex ZL, particle size: 70–100 $\mu$m, product of Nissan Chemicals) | 0.12 g |
| Water to make | 100 g |

Further, 10 wt % of KOH was added to this coating solution and the pH was adjusted to 6. The resulting coating solution was coated on the above support at 180° C. over 2 min. so as to provide a dry film thickness of 0.9 $\mu$m.

| Second Undercoat Layer | |
|---|---|
| Gelatin | 1 g |
| Methyl Cellulose | 0.05 g |
| Compound 2 | 0.02 g |
| $C_{12}H_{25}O(CH_2H_2O)_{10}H$ | 0.02 g |
| Compound 3 | $3.5 \times 10^{-3}$ g |
| Acetic Acid | 0.2 g |
| Water to make | 100 g |

This coating solution was coated at a drying temperature of 170° C. over 2 min. so as to provide a dry film thickness of 0.1 $\mu$m.

Core/Shell Type Vinylidene Chloride Copolymer (1)

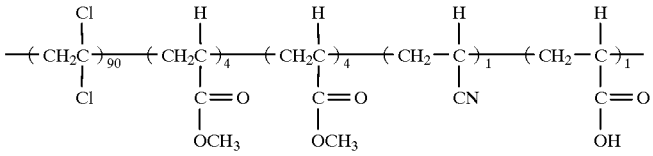

Core: VDC/MMA/MA (80 wt %)

Shell: VDC/AN/AA (20 wt %)

Average grain size: 70 nm

-continued

Compound 1

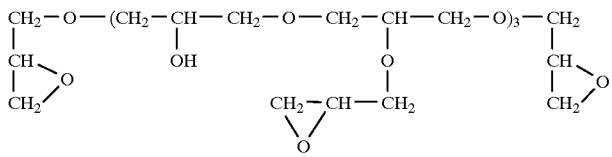

Compound 2

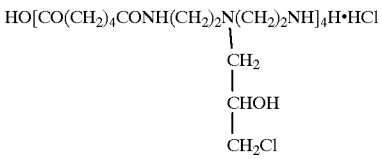

Compound 3

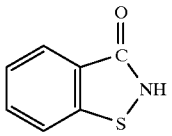

On one side of the support, an emulsion layer, a lower protective layer and an upper protective layer each having the composition shown below were coated simultaneously.

Emulsion Layer

Solution I: 300 ml of water, 9 g of gelatin

Solution II: 100 g of $AgNO_3$, 400 ml of water

Solution III: 37 g of NaCl, 1.1 ml of $(NH_4)_3RhCl_{15}$, 400 ml of water

Solution II and Solution III were added simultaneously at a constant rate to Solution I which was maintained at 45° C. After soluble salt was removed from this emulsion by a well known ordinary method in the art, gelatin was added and 6-methyl-4-hydroxy-1,3,3a,7-tetraazaindene was added as a stabilizer. The average grain size of this monodisperse emulsion was 0.15 $\mu$m (variation coefficient: 10%).

The following compounds were added to the thus-obtained emulsion.

| | |
|---|---|
| Hydrazine Derivative I-77 | $3 \times 10^3$ mol/mol Ag |
| Compound 4 | 60 mg/m$^2$ |
| Compound 5 | 9 mg/m$^2$ |
| Compound 3 | 10 mg/m$^2$ |
| Compound 6 | 25 mg/m$^2$ |
| Sodium Polystyrenesulfonate | 500 mg/m$^2$ |
| Sodium N-oleoyl-N-methyltaurine | 85 mg/m$^2$ |
| 1-Phenyl-5-mercaptotetrazole | 3 mg/m$^2$ |
| 1,2-Bis(vinylsulfonylacetamido)ethane | 58 mg/m$^2$ |

Polymer Latex (shown in Table 3) 960 mg/m$^2$

This coating solution was coated on the support in an amount such that the coated amount of silver and gelatin reached 3.0 g/m$^2$ and 1.2 g/m$^2$, respectively.

Compound 4

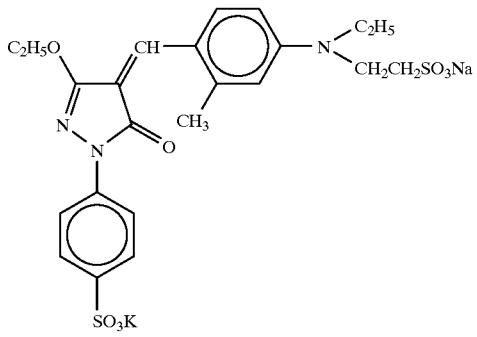

-continued
Compound 5
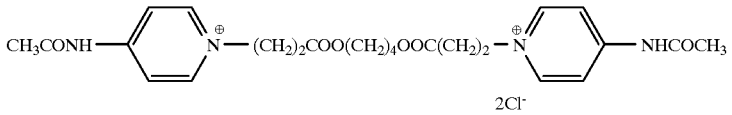
Compound 3
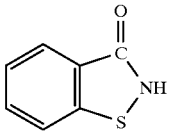
Compound 6
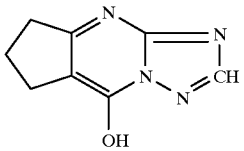
Lower Protective Layer
| | |
|---|---|
| Gelatin | 1.0 g/m$^2$ |
| Lipoic Acid | 5 mg/m$^2$ |
| Sodium Dodecylbenzenesulfonate | 5 mg/m$^2$ |
| Compound 7 | 20 mg/m$^2$ |
| Sodium Polystyrenesulfonate | 10 mg/m$^2$ |
| Compound 4 | 50 mg/m$^2$ |
| Compound 8 | 30 mg/m$^2$ |
| Compound 9 | 5 mg/m$^2$ |
| Polymer Latex (shown in Table 3) | 700 mg/m$^2$ |
Compound 7
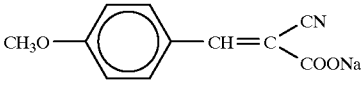
Compound 8
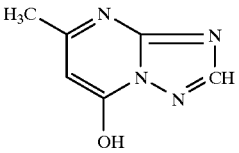
Compound 9
$C_2H_5SO_2SNa$ -continued Compound 4

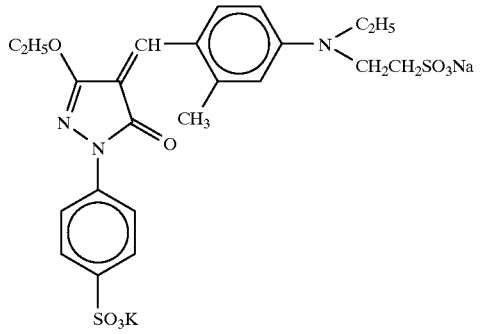

Upper Protective Layer

| | |
|---|---|
| Gelatin | 0.60 g/m$^2$ |
| Fine Powder Particles of Silicon Dioxide (average particle size: 3.5 μm, port diameter: 25 Å, surface area: 700 m$^2$/g) | 50 mg/m$^2$ |
| Sodium Dodecylbenzenesulfonate | 20 mg/m$^2$ |
| Potassium Perfluorooctanesulfonate | 10 mg/m$^2$ |
| N-Perfluorooctanesulfonyl-N-propylglycine Potassium Salt | 3 mg/m$^2$ |
| Sodium Polystyrenesulfonate | 2 mg/m$^2$ |
| Sulfuric Acid Ester Sodium Salt of Poly(polymerization degree: 5)oxyethylenenonylphenyl Ether | 20 mg/m$^2$ |
| Liquid Paraffin | 40 mg/m$^2$ |
| Colloidal Silica (Snowtex C, manufactured by Nissan Chemicals) | 15 mg/m$^2$ |

Subsequently, a conductive layer and a backing layer each having the following composition were simultaneously coated on the opposite side of the support.

| Conductive Layer | |
|---|---|
| $SnO_2$/Sb (9/1 by weight ratio, average grain size: 0.25 μm) | 250 mg/m$^2$ |
| Gelatin ($Ca^{++}$ content: 3,000 ppm) | 100 mg/m$^2$ |
| Compound 3 | 7 mg/m$^2$ |
| Sodium Dodecylbenzenesulfonate | 20 mg/m$^2$ |
| Dihexyl-α-sulfosuccinate Sodium Salt | 20 mg/m$^2$ |
| Sodium Polystyrenesulfonate | 20 mg/m$^2$ |
| **Backing Layer** | |
| Gelatin ($Ca^{++}$ content: 30 ppm) | 2.0 g/m$^2$ |
| Compound 11 | 280 mg/m$^2$ |
| Compound 12 | 60 mg/m$^2$ |
| Compound 13 | 35 mg/m$^2$ |
| Compound 3 | 10 mg/m$^2$ |
| Sodium Dodecylbenzenesulfonate | 80 mg/m$^2$ |
| Dibenzyl-α-sulfosuccinate Sodium Salt | 20 mg/m$^2$ |
| 1,2-Bis(vinylsulfonylacetamido)ethane | 150 mg/m$^2$ |
| Lithium Perfluorooctanesulfonate | 5 mg/m$^2$ |
| Fine Powder Particles of Silicon Dioxide (average particle size: 4 μm, port diameter: 170 Å, surface area: 300 m$^2$/g) | 35 mg/m$^2$ |
| Sodium Sulfate | 230 mg/m$^2$ |

-continued

Compound 3

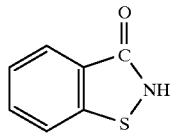

Compound 10

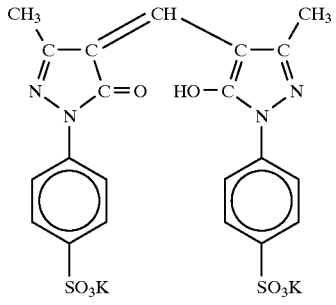

-continued

Compound 11

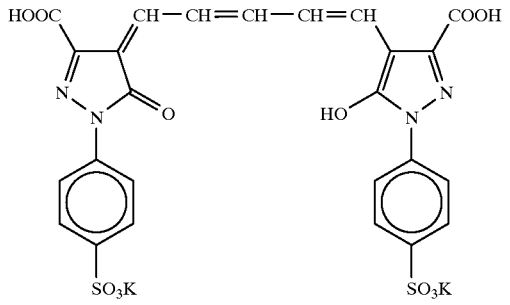

Compound 12

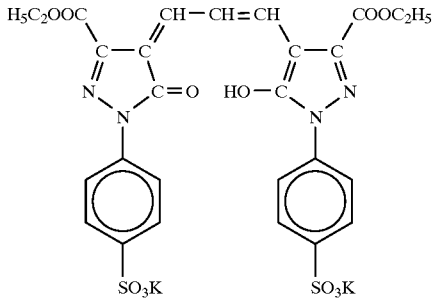

Samples obtained were preserved under the atmosphere of 25° C., 45% RH for one week, then evaluations were conducted with respect to the following items.

(1) Photographic Performance (gamma value)

Photographic performance was evaluated in the same manner as in Example 2 except that exposure was carried out using a fine light filter type B for the daylight printer.

(2) Wet Film Strength

Evaluation was carried out in the same manner as in Example 2.

(3) Brittleness

Samples were allowed to stand at 25° C., 10% RH for 2 hours, then the average value of the points where a crack was generated for the first time on the side on which silver halide emulsion layers were provided was determined in the same method as LS06077 Wedye brittleness test.

(4) Adhesiveness

The samples were cut into a 4 cm×4 cm size, after being allowed to stand at 35° C., 80% RH for 3 hours in sets of two sheets, the surface having the emulsion layer and the opposite surface of the samples of the same set were contacted and 1 kg of load was applied and allowed to stand at 35° C., 80% RH for 24 hours. Then, the load was removed and the area of the part adhered of the surface having emulsion layers with the opposite surface was measured.

Grade A: adhered area accounts for 0 to 25%

Grade B: adhered area accounts for 26 to 50%

Grade C: adhered area accounts for 51 to 75%

Grade D: adhered area accounts for 76 to 100%

(5) Mechanical Stability of Latex

Evaluation was carried out by the same method as Maron's mechanical friction testing method (S. H. Maron, I. N. Uleritch, *Anal. Chem.,* 25, 1087 (1953)).

100 g of sample latex having a concentration of 20 wt % was put in a vessel, shearing force was applied under the conditions of 1,000 rpm, 10 kg load, 5 min and 36° C., and the weight of agglomerates was obtained.

The results obtained are shown in Table 3. As is apparent from Table 3, the samples of the present invention provide superhigh contrast images, strong wet film strength and, further, the latex shows conspicuously high mechanical stability by controlling Tg of the core part to be lower and Tg of the shell part to be higher, therefore, the samples of the present invention are excellent in physical properties of the film such as brittleness and adhesiveness.

TABLE 3

| | Polymer Latex Composition*(wt %) | | | Tg (calculated value) | | | (2) | (3) | | (5) |
|---|---|---|---|---|---|---|---|---|---|---|
| Sample No. | Core Part | Shell Part | Core/ Shell Ratio | Core Part (°C.) | Shell Part (°C.) | (1) Gamma Value | Wet Film Strength (g) | Brittle ness (mm) | (4) Adhesive ness | Mechanical Stability (mg) |
| 35 (Invention) | St/Bu = 37/63 | St/AAEMA = 84/16 | 50/50 | −59 | 94 | 15 | 200 | 3 | A | 5 |
| 36 (Invention) | | St/MA/AAEMA = 42/42/16 | " | " | 51 | " | " | " | A | " |
| 37 (Invention) | | MA/AAEMA = 84/16 | " | " | 17 | " | " | 2 | A | " |
| 38 (Invention) | | EA/AAEMA = 84/16 | " | " | −13 | 13 | 190 | " | C | 30 |
| 39 (Invention) | | BA/AAEMA = 84/16 | " | " | −41 | " | " | " | D | 45 |
| 40 | Comparative Example 3 BA/AA/AAEMA = 80/4/16 | | | −37° C. | | 9 | 150 | " | D | 300 |

*St: Styrene
Bu: Butadiene
MA: Methyl acrylate
EA: Ethyl acrylate
BA: Butyl acrylate
AA: Acrylic acid
AAEMA: 2-Acetoacetoxyethyl methacrylate (M-1)

Emulsifier-1

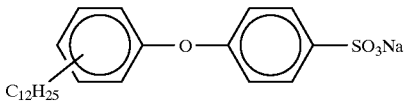

Addition amount: 0.5 wt % (based on the solid part of the latex)

Emulsifier-2

$CH_3(CH_2)_{11}CH{=}CHSO_3Na$ (a)

$CH_3(CH_2)_{11}CH_2{-}CH_2SO_3Na$ (b)

a/b=6/4 (mol ratio)

Addition amount: 0.3 wt % (based on the solid part of the latex)

Example 4

A sample was prepared in the same manner as the preparation of Sample No. 17 in Example 1 except that the emulsion in Sample No. 17 was replaced with Emulsion B indicated below and the sensitizing dye in EM layer was replaced with $2.1\times10^{-4}$ mol per mol of silver of the following Compound (S-3).

Emulsion B

Emulsion B was prepared in the same manner as the preparation of Emulsion A in Example 1 except that 1 mg of a selenium sensitizer having the following structural formula, 1 mg of sodium thiosulfate and 4 mg of chloroauric acid were added, each per mol of silver, and optimally chemically sensitized at 60° C.

Compound (S-3)

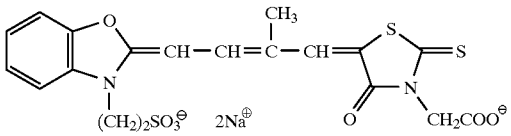

-continued

Selenium Sensitizer

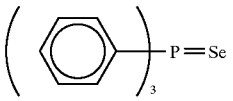

The thus-obtained sample was preserved and evaluated in the same manner as in Example 1, but in this example, evaluation of photographic performance was conducted by using an interference filter which had a peak at 633 nm and exposing the sample with a xenon flash light of $10^{-6}$ sec. Development processing was the same as in Example 1.

Similarly to the results in Example 1, a photographic material for helium-neon laser scanner having extremely high contrast photographic characteristics and strong wet film strength could be obtained.

Example 5

A sample was prepared in the same manner as in Example 4 except that the sensitizing dye in EM layer was replaced with $5.4\times10^{-5}$ mol per mol of silver of the following Compound (S-4), a stabilizer was replaced with 350 mg/AgI mol of disodium 4,4'-bis(4,6-dinaphthoxypyrimidin-2-ylamino)stilbenedisulfonate and 450 mg/Ag of an iodide salt of 2,5-dimethyl-3-allyl-benzothiazole, and the backing layer was replaced with a backing layer and a backing protective layer having the compositions shown below.

Compound (S-4)

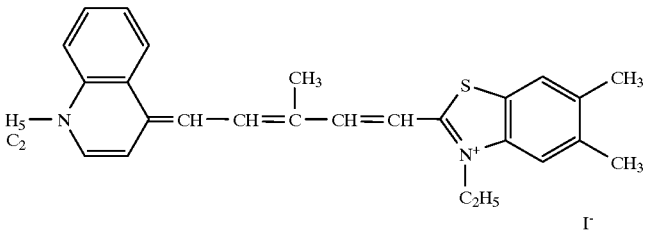

Backing Layer

| | |
|---|---|
| Gelatin | 2.0 g/m$^2$ |
| Compound (1) | 3 mg/m$^2$ |
| Dye a | 35 mg/m$^2$ |
| Dye b | 95 mg/m$^2$ |
| Dye c | 70 mg/m$^2$ |
| Dihexyl-α-sulfosuccinate Sodium Salt | 25 mg/m$^2$ |
| Sodium Dodecylbenzenesulfonate | 35 mg/m$^2$ |
| Acetic Acid | 10 mg/m$^2$ |
| 1,3-Divinylsulfonyl-2-propanol | 130 mg/m$^2$ |

-continued
| Backing Protective Layer | |
|---|---|
| Gelatin | 0.8 g/m$^2$ |
| Compound (1) | 1 mg/m$^2$ |
| Polymethyl Methacrylate Fine Particles (average particle size: 3.4 μm) | 35 mg/m$^2$ |
| Dihexyl-α-sulfosuccinate Sodium Salt | 7 mg/m$^2$ |
| Sodium Dodecylbenzenesulfonate | 10 mg/m$^2$ |
| Compound (2) | 2 mg/m$^2$ |
| Sodium Acetate | 30 mg/m$^2$ |
Compound (1)
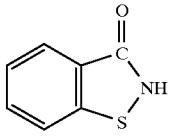
Compound (2)
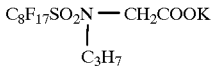
Dye a
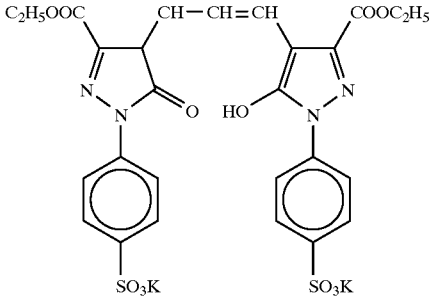
Dye b
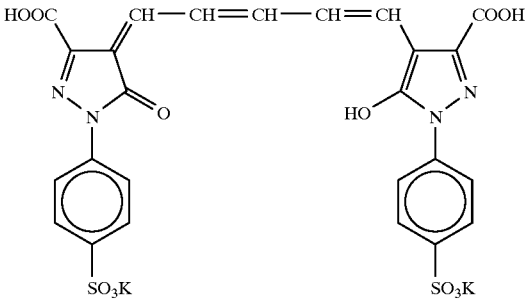
Dye c
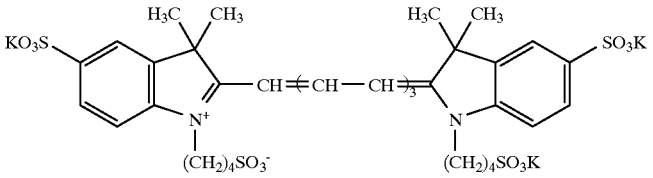

The thus obtained sample was evaluated in the same manner as in Example 4, but in this example, evaluation of photographic performance was conducted by using an interference filter which had a peak at 780 nm.

Similarly to the results in Example 4, a photographic material for semiconductor laser scanner having extremely high contrast photographic characteristics and strong wet film strength could be obtained.

Example 6

A sample was prepared in the same manner as the preparation of Sample No. 9 in Example 1 except that the sensitizing dye in EM layer was replaced with the following Compound (S-5).

Compound (S-5)

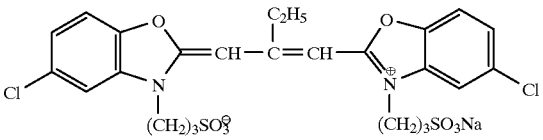

The thus-obtained sample was evaluated in the same manner as in Example 1, but in this example, evaluation of photographic performance was conducted by using a tungsten light of 3,200° K. for exposure and development processing was carried out in the same manner as in Example 1.

Similarly to the results in Example 1, a photographic material for photographing having extremely high contrast photographic characteristics and strong wet film strength could be obtained.

Example 7

Evaluation of photographic performances was conducted in the same manner as in Example 1 using the samples in Example 1 with changing the replenishment rate of the developing solution as shown in Table 4. The results obtained are shown in Table 4. As is clearly understood from Table 4, the samples of the present invention can maintain high gamma values even when the replenishment rate is reduced.

TABLE 4

| Test No. | Sample No. | Replenishment Rate of Developing Solution (ml/m$^2$) | Relative Sensitivity* | Gamma Value |
|---|---|---|---|---|
| 1 | 1 | 350 | 100 | 26 |
| 2 | 9 | " | " | 26 |
| 3 | 17 | " | " | 26 |
| 4 | 1 | 300 | " | 26 |
| 5 | 9 | " | " | 25 |
| 6 | 17 | " | " | 26 |
| 7 | 1 | 250 | " | 25 |
| 8 | 9 | " | " | 26 |
| 9 | 17 | " | " | 24 |
| 10 | 1 | 200 | " | 25 |
| 11 | 9 | " | " | 24 |
| 12 | 17 | " | " | 25 |
| 13 | 1 | 150 | 98 | 22 |
| 14 | 9 | " | " | 21 |
| 15 | 17 | " | " | 21 |
| 16 | 7 | 350 | 93 | 18 |

TABLE 4-continued

| Test No. | Sample No. | Replenishment Rate of Developing Solution (ml/m$^2$) | Relative Sensitivity* | Gamma Value |
|---|---|---|---|---|
| 17 | 15 | " | " | 19 |
| 18 | 23 | " | " | 19 |
| 19 | 7 | 300 | 91 | 16 |
| 20 | 15 | " | " | 17 |
| 21 | 23 | " | " | 16 |
| 22 | 7 | 250 | 87 | 13 |
| 23 | 15 | " | " | 12 |
| 24 | 23 | " | " | 13 |
| 25 | 7 | 200 | 85 | 10 |
| 26 | 15 | " | " | 9 |
| 27 | 23 | " | " | 9 |

*The sensitivity is the logarithmic value of the exposure amount required to give a density of 1.5, and is expressed in relative sensitivity with Test No. 1 being taken as 100.

Example 8

Samples were prepared by replacing the support of each of Samples Nos. 9 and 17 in Example 1, Sample Nos. 28 and 30 in Example 2, Sample No. 35 in Example 3, samples in Examples 4, 5 and 6 with the styrene copolymer (thickness: 120 $\mu$m) having the syndiotactic structure disclosed in Example 1 of Japanese Patent Application No. 6-46606, and photographic performances and wet film strength were evaluated by the same conditions in each example. As a result, photographic materials having excellent wet film strength, dimensional stability and extremely high contrast could be obtained.

Example 9

Samples of the present invention in Examples 1, 4, 5, 6, 7 and 8 were development processed by the same conditions in each example using the following Developing Solutions C and D in place of Developing Solution A used in Examples 1, 4, 5, 6, 7 and 8. The replenishment rate was 170 ml/m$^2$.

| Developing Solution C | |
|---|---|
| Potassium Hydroxide | 35 g |
| Diethylenetriaminepentaacetic Acid | 2 g |
| Potassium Carbonate | 100 |
| Potassium Bromide | 3 g |
| 5-Methylbenzotriazole | 0.08 g |
| Sodium 2-Mercaptobenzimidazole-5-sulfonate | 0.15 g |
| 2,3,5,6,7,8-Hexahydro-2-thioxo-4-(1H)-quinazolinone | 0.03 g |
| Sodium Metabisulfite | 54 g |
| 4-Hydroxymethyl-4-methyl-1-phenyl-3-pyrazolidone | 0.45 g |
| Hydroquinone | 30 g |
| Sodium Erythorbate | 3 g |
| Water to make | 1 liter |
| pH was adjusted with sodium hydroxide | 10.5 |

| Developing Solution D | |
|---|---|
| Sodium Hydroxide | 10.0 g |
| Diethylenetriaminepentaacetic Acid | 1.5 g |
| Potassium Carbonate | 15.0 g |
| Potassium Bromide | 3.0 g |
| 5-Methylbenzotriazole | 0.10 g |
| 1-Phenyl-5-mercaptotetrazole | 0.02 g |
| Potassium Sulfite | 10.0 g |
| Sodium 2-Mercaptobenzimidazole-5-sulfonate | 0.15 g |

-continued

| | |
|---|---|
| 4-Hydroxymethyl-4-methyl-1-phenyl-3-pyrazolidone | 0.40 g |
| Sodium Erythorbate | 30.0 g |
| Water to make | 1 liter |
| pH was adjusted with potassium hydroxide | 10.7 |

Further, Developing Solution B was prepared from a solid type which was preserved at a solid state.

A component of a developing solution of a solid type processing agent was put into a bag of an aluminum foil coated on a plastic material in lamination as a solid state. The order of lamination was from the above:

First Layer: Hydroquinone

Second Layer: Other component

Third Layer: Sodium Bisulfite

Fourth Layer: Potassium Carbonate

Fifth Layer: Potassium Hydroxide Pellet Exhaust was conducted in the ordinary method. The system was made vacuum and sealed.

The same results were obtained also when using Developing Solutions C and D in development processing of the samples in Examples 1, 4, 5, 6, 7 and 8.

While the invention has been described in detail and with reference to specific examples thereof, it will be apparent to one skilled in the art that various changes and modifications can be made therein without departing from the spirit and scope thereof.

What is claimed is:

1. A silver halide photographic material which comprises a support having thereon at least one silver halide emulsion layer and at least one undercoat layer, which undercoat layer abuts the support, wherein the photographic material contains a hydrazine derivative and a polymer latex having a core/shell structure which are each incorporated in at least one of the silver halide emulsion layers and other hydrophilic colloid layers of the photographic material which do not abut the support, wherein the layer in which the hydrazine derivative is incorporated and the layer in which the polymer latex is incorporated may be the same or different, and wherein the shell part of said polymer latex having a core/shell structure has repeating units comprising ethylenically unsaturated monomers which contain an active methylene group represented by the following formula (I):

(I)

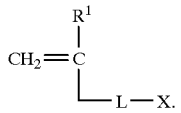

wherein $R_1$ is a hydrogen atom, an alkyl group having from 1 to 4 carbon atoms, or a halogen atom, L is a single bond or a divalent linking group, X is an active methylene group selected from the group consisting of $R^2COCH_2COO$—, NC—$CH_2$ COO—, $R^2COCH_2CO$—, NC—$CH_2CO$—, and $R^9COCH_2$ CON($R^6$)—, wherein $R^2$ is a substituted or unsubstituted alkyl group having from 1 to 12 carbon atoms, a substituted or unsubstituted aryl group having from 6 to 20 carbon atoms, an alkoxyl group having from 1 to 12 carbon atoms, an amino group, or a substituted amino group having from 1 to 12 carbon atoms, $R^6$ is a hydrogen atom or a substituted or unsubstituted alkyl group having from 1 to 6 carbon atoms, and $R^9$ is a substituted or unsubstituted primary or secondary alkyl group having from 1 to 12 carbon atoms, an alkoxyl group having from 1 to 12 carbon atoms, an amino group or a substituted amino group having from 1 to 12 carbon atoms, and L is bonded to X in the form of alkylene, aralkylene or arylene.

2. The silver halide photographic material of claim 1, wherein the total gelatin amount of all the hydrophilic colloid layers on the side of the support on which the emulsion layer is provided is 3 g/$m^2$ or less and the total gelatin amount of all the hydrophilic colloid layers on the side of the support on which the emulsion layer is provided and on the opposite side thereof is 6 g/$m^2$ or less.

3. The silver halide photographic material of claim 1, wherein development processing is carried out with a developing solution having pH of from 9.0 to 13.0 and the replenishment rate of the developing solution is 300 ml/$m^2$ or less.

4. The silver halide photographic material of claim 1, wherein Tg (glass transition temperature) of the core part of said polymer latex having a core/shell structure is lower than Tg of the shell part.

5. The silver halide photographic material of claim 4, wherein development processing is carried out with a developing solution having pH of from 9.0 to 13.0 and the replenishment rate of the developing solution is 300 ml/$m^2$ or less.

* * * * *